US007979016B2

(12) United States Patent
Hatakeyama et al.

(10) Patent No.: US 7,979,016 B2
(45) Date of Patent: Jul. 12, 2011

(54) IMAGE FORMING APPARATUS AND PROTECTIVE AGENT BLOCK

(75) Inventors: Kumiko Hatakeyama, Sagamihara (JP); Toshiyuki Kabata, Yokohama (JP); Kunio Hasegawa, Isehara (JP); Masahide Yamashita, Tokyo-to (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 12/470,801

(22) Filed: May 22, 2009

(65) Prior Publication Data

US 2009/0290920 A1 Nov. 26, 2009

(30) Foreign Application Priority Data

May 23, 2008 (JP) ..... 2008-135197
May 29, 2008 (JP) ..... 2008-140428

(51) Int. Cl.
*G03G 21/00* (2006.01)

(52) U.S. Cl. ..... 399/346

(58) Field of Classification Search ..... 399/111, 399/346; 430/126.2
See application file for complete search history.

(56) References Cited

U.S. PATENT DOCUMENTS

| | | | | |
|---|---|---|---|---|
| 3,501,294 | A | 3/1970 | Joseph | |
| 6,821,694 | B2 | 11/2004 | Kabata et al. | |
| 6,830,857 | B2 | 12/2004 | Kabata et al. | |
| 7,027,759 | B2 | 4/2006 | Kabata et al. | |
| 7,181,156 | B2 | 2/2007 | Kabata et al. | |
| 7,209,699 | B2 * | 4/2007 | Yamaguchi et al. | 399/346 |
| 7,212,777 | B2 * | 5/2007 | Takada et al. | 399/346 X |
| 7,218,879 | B2 | 5/2007 | Enoki et al. | |
| 7,295,802 | B2 | 11/2007 | Kabata et al. | |
| 7,315,711 | B2 | 1/2008 | Ariizumi et al. | |
| 7,486,914 | B2 | 2/2009 | Kabata et al. | |
| 7,499,664 | B2 | 3/2009 | Koichi et al. | |
| 2006/0285897 | A1 | 12/2006 | Sugiura et al. | |
| 2007/0123435 | A1 * | 5/2007 | Usami | 508/100 |
| 2007/0224528 | A1 | 9/2007 | Yamashita et al. | |
| 2007/0258723 | A1 | 11/2007 | Nakazato et al. | |
| 2008/0068639 | A1 | 3/2008 | Satoh et al. | |

FOREIGN PATENT DOCUMENTS

| | | |
|---|---|---|
| JP | 51-22380 | 7/1976 |
| JP | 10-110197 | 4/1998 |
| JP | 2004-198662 | 7/2004 |
| JP | 2005-17469 | 1/2005 |
| JP | 2006-350240 | 12/2006 |

* cited by examiner

*Primary Examiner* — Sandra L Brase
(74) *Attorney, Agent, or Firm* — Cooper & Dunham LLP

(57) ABSTRACT

An image forming apparatus including an image bearing member that bears a latent electrostatic image on the surface thereof, a charging device that uniformly charges the surface of the image bearing member, an irradiation device that irradiates the surface of the image bearing member to form the latent electrostatic image thereon, a development device that develops the latent electrostatic image on the surface of the image bearing member with toner to form a toner image thereon, a transfer device that transfers the toner image to a transfer body, a cleaning device including a cleaning blade that removes residual toner remaining on the surface of the image bearing member with the cleaning blade, a protective agent application device that applies a protective agent containing zinc stearate and zinc palmitate to the surface of the image bearing member, wherein the ratio of the zinc stearate and the zinc palmitate is from 66:34 to 40:60 by weight.

10 Claims, 5 Drawing Sheets

IMAGE FORMING APPARATUS AND PROTECTIVE AGENT BLOCK

BACKGROUND OF THE INVENTION

Field of the Invention

The present invention relates to an image forming apparatus and a protective agent for use therein.

In the image forming apparatus using electrophotographic process, images are formed by processes of charging, irradiation, development, transfer etc. applied to an image bearing member. The residual toner or toner component remaining on the surface of the image bearing member after the transfer process is removed by a cleaning process.

A cleaning system having a rubber blade is typically used because such a rubber blade has a simple and cost-saving mechanism with a good cleaning property. However, since the rubber blade is pressed against the image bearing member to remove residual material on the surface thereof, the cleaning blade is under a large mechanical stress caused by frication between the surface of the image bearing member and the cleaning blade. This leads to attrition of the rubber blade and the surface layer of the image bearing member particularly in the case of an organic photoconductor, which shortens the working life of the rubber blade and the organic photoconductor. In addition, the toner for use in image formation is reduced in size to deal with the demand for improvement on the image quality. In the case of an image forming apparatus using a toner having a small particle diameter, the ratio of residual toner that slips through the edge portion of the cleaning blade and the surface of the image bearing member tends to increase. This is especially true when the dimension accuracy and/or assembly accuracy is not sufficient or the cleaning blade partially vibrates, which degrades the quality of images.

Therefore, to elongate the working life of an image bearing member while maintaining the quality of images over a long period of time, reducing the deterioration of members caused by abrasion and improving the cleaning property are demanded.

To meet this demand, a method described in examined published Japanese patent application No. S51-22380 is adopted in which a brush is pressed against a metal soap block formed of zinc stearate, etc., to obtain finely powdered metal soap and the obtained fine powder is supplied to an image bearing member to form a film of a lubricant by a cleaning blade.

Metal soap formed of zinc stearate, etc. improves the lubrication property of the surface of the image bearing member and reduces the abrasion between the image bearing member and the cleaning blade. In addition, the cleaning property of the residual toner is improved. Therefore, using such metal soap is extremely preferred.

In addition, a charging roller employing a charging system in which an AC voltage is overlapped with a DC voltage has been widely used in recent years in the charging process. This AC charging system has advantages with regard to uniform charging of the image bearing member, less production of ozone or acid gas such as $NO_x$, size reduction of the system, etc. However, the surface layer of the image bearing member tends to deteriorate soon since positive and negative discharging is repetitively conducted several hundreds or thousands of times per second between the charging member and the image bearing member. To deal with this deterioration problem, a lubricant is coated on the surface of an image bearing member. This is because when deterioration causing energy by AC charging is applied to the surface of an image bearing member on which the lubricant is coated, the deterioration causing energy is absorbed first in the lubricant and hardly reaches the image bearing member. That is, the image bearing member is protected.

The deterioration causing energy by AC charging decomposes the metal soap but the metal soap is not completely decomposed or does not disappear. Actually, fatty acids having a low molecular weight are produced and the friction between the image bearing member and the cleaning blade tends to increase. Furthermore, the toner component is easily attached to the surface of the image bearing member in a filming manner together with the fatty acids, which leads to problems such as a decrease in the definition of images and uneven density due to the abrasion of the surface of the image bearing member. Therefore, when such fatty acids are produced, a massive amount of metal soap should be supplied to the surface of the image bearing member to cover all over the surface of the image bearing member again soon.

Such metal soap has an extremely high protection effect for an image bearing member. Thus, various kinds of metal soaps are tested and finally zinc stearate is found to be preferable. For example, unexamined published Japanese patent application No. (hereinafter referred to as JOP) 2004-198662 describes an image forming apparatus which defines a preferable covering ratio of zinc stearate for the image bearing member by X-ray photoelectron spectroscopy (XPS) analysis and X-ray florescence (XRF) analysis.

In addition, JOP 2005-17469 describes an image forming apparatus in which the ratio of Zn in zinc stearate applied to the image bearing member is at least the parameter value calculated based on the charging conditions.

In these image forming apparatuses, since zinc stearate covers all over the surface of the image bearing member, highly durable quality image formation is possible. However, when the linear speed of the image bearing member is increased to speed up the image formation, the zinc stearate does not keep up with the image formation speed so that the zinc stearate cannot cover all over the surface of the image bearing member, which shortens the working life of the image bearing member.

JOP 2006-350240 describes an image forming apparatus having an image bearing member to which a mixture of zinc stearate and boron nitride is applied as a protective agent. The surface of an image bearing member is more easily covered by zinc stearate when such a mixture of zinc stearate and boron nitride is used than a sole use of zinc stearate because of the presence of boron nitride. Therefore, an increase of the friction resistance of an image bearing member can be reduced even when image formation is repeated. This is true when the linear speed of the image bearing member in an image forming apparatus is slow. However, as the image formation speed increases, the protective agent cannot cover all over the surface of the image bearing member as in the case described above. As a result, this image forming apparatus is not desirable to reduce the production of abnormal images having streaks.

JOP H10-110197 describes a method of manufacturing a protective agent block by mixing zinc stearate and zinc palmitate with a ratio of 2:1 by weight, melting the mixture and placing the melted mixture in a die followed by cooling down. The protective agent block hardly cracks or chips when the die is cooled down because zinc stearate and zinc palmitate are mixed with a weight ratio of 2:1. Therefore, the productivity of the mixture is good. However, when images are formed at a high speed, the quality of produced images is significantly sensitive to the kind of metal salts of fatty acids and the mixing ratio thereof for the protective agent block. Particularly, the mixing ratio of zinc stearate and zinc palmitate has a critical significance with regard to the image quality. Therefore, the problem of elongation of the working life of an image bearing member at high speed image formation is not solved by using the protective agent block formed by the mixture of zinc stearate and zinc palmitate with a ratio of 2:1.

In addition, the cover ratio of the mixture of zinc stearate and zinc palmitate is calculated according to XPS analysis as described in JOP 2004-198662. The cover ratio of the image bearing member by the mixture under the application condition such that quality images can be produced over a long period of time is occasionally over 100%. Further, when the mixture is applied under the mechanical condition such that the cover ratio is within the range defined in JOP 2004-198662, trouble occurs in some cases. However, the causes of the trouble even when the cover ratio is within the defined range or that the cover ratio surpasses 100% are unidentified.

SUMMARY OF THE INVENTION

Because of these reasons, the present inventors recognize that a need exists for an image forming apparatus capable of producing quality images for a long period of time and protecting the image bearing member therein even when the linear speed of the image bearing member is high, and a protective agent for use in the image forming apparatus.

Accordingly, an object of the present invention is to provide an image forming apparatus capable of producing quality images for a long period of time and protecting the image bearing member therein even when the linear speed of the image bearing member is high, and a protective agent for use in the image forming apparatus.

Briefly this object and other objects of the present invention as hereinafter described will become more readily apparent and can be attained, either individually or in combination thereof, by an image forming apparatus including an image bearing member that bears a latent electrostatic image on the surface thereof, a charging device that uniformly charges the surface of the image bearing member, an irradiation device that irradiates the surface of the image bearing member to form the latent electrostatic image thereon, a development device that develops the latent electrostatic image on the surface of the image bearing member with toner to form the toner image thereon, a transfer device that transfers the toner image to a transfer body, a cleaning device including a cleaning blade that removes residual toner remaining on the surface of the image bearing member with the cleaning blade, a protective agent application device that applies a protective agent containing zinc stearate and zinc palmitate to the surface of the image bearing member. In addition, the ratio of the zinc stearate and the zinc palmitate is from 66:34 to 40:60 by weight.

It is preferred that, in the image forming apparatus mentioned above, with regard to C1s spectrum detected when the image bearing member is analyzed by X-ray photoelectron spectroscopy (XPS) before the protective agent is applied to the surface of the image bearing member and peaks obtained by separating waveforms generated from different bonding statuses of carbon atoms according to binding energy, the image bearing member has a ratio $A_0$ of the sum of peak areas having a top of the peaks in a range of from 290.3 to 294 eV to the total area of the C1s spectrum of at least 3%, and with regard to Cls spectrum detected when the image bearing member is analyzed by X-ray photoelectron spectroscopy (XPS) after 500 images are output while the protective agent is applied to the image bearing member and the peaks obtained by separating waveforms generated from different bonding statuses of carbon atoms according to binding energy, the ratio A of a sum of peak areas having a top of the peaks in the range of from 290.3 to 294 eV to the total area of the C1s spectrum satisfies the following relationship: $(A_0-A)/A_0\times100\geqq90(\%)$.

It is still further preferred that, in the image forming apparatus mentioned above, the protective agent is manufactured by compacting molding.

It is still further preferred that, in the image forming apparatus mentioned above, the protective agent comprises boron nitride.

It is still further preferred that, in the image forming apparatus mentioned above, the content of the boron nitride of from 1 to 25% by weight based on the total content of the protective agent.

It is still further preferred that, in the image forming apparatus mentioned above, the image bearing member has a linear velocity of 180 mm/s or higher.

It is still further preferred that, in the image forming apparatus mentioned above, the charging device uniformly charges the surface of the image bearing member by applying a voltage in which an AC voltage is overlapped with a DC voltage to the image bearing member.

It is still further preferred that, in the image forming apparatus mentioned above, the protective agent application device is provided on the downstream side from the cleaning device relative to the rotation direction of the image bearing member.

As another aspect of the present invention, a process cartridge is provided which includes an image bearing member that bears a latent electrostatic image on the surface thereof, a protective agent application device that applies a protective agent containing zinc stearate and zinc palmitate to the surface of the image bearing member, at least one device selected from the group consisting of a charging device, an irradiation device, a development device, and a cleaning device. In addition, the process cartridge is detachably attachable to the image forming apparatus mentioned above.

As another aspect of the present invention, a protective agent block is provided which contains zinc stearate, and zinc palmitate. In addition, the protective agent block is attached to the image forming apparatus mentioned above.

As another aspect of the present invention, a protective agent block is provided which contains zinc stearate, and zinc palmitate. In addition, the protective agent block is attached to the process cartridge mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
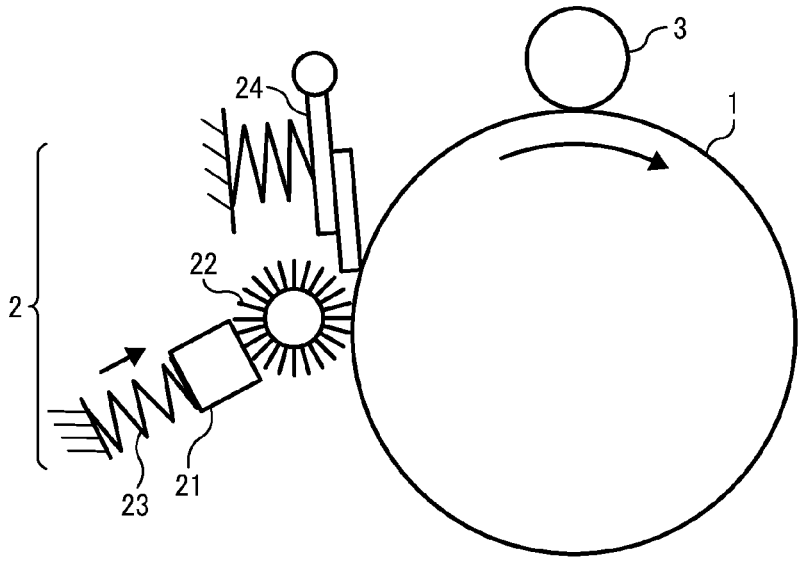
FIG. 1 is a schematic diagram illustrating an example of the protection layer formation device for use in the present invention.

The present invention will be described below in detail with reference to several embodiments and accompanying drawings.

In the process of applying zinc stearate having a block form to the surface of the image bearing member in an image forming apparatus, the zinc stearate having a block form are scraped and finely-pulverized by a brush and extended by a blade. According to detailed observation of the application process, the present inventors have found that, as the linear velocity of the image bearing member increases, the speed of extending the zinc stearate falls behind the linear velocity.

Therefore, various kinds of studies have been made on a mixture of zinc stearate and zinc palmitae having a smaller molecular weight than that of zinc stearate. As a result, the present inventors have found that zinc palmitate is hardly effective in a small amount but as the addition amount of zinc palmitate increases, especially when the addition amount surpasses 34%, zinc stearate and zinc palmitate in a protective agent are both extended by a blade and cover the surface of the image bearing member.

Zinc stearate and zinc palmitate are both metal salts of fatty acid. With regard to the aliphatic portion thereof, the numbers of carbon atoms in stearic acid and in palmitic acid are 18 and 16, respectively. Thus, the structures of zinc stearate and zinc palmitate are similar to each other and compatible well so that both compounds tend to behave as the significantly same material.

In addition, since zinc palmitate has a lower melting point than zinc stearate, the protective agent containing both compounds are easily extended by a blade when zinc palmitate contained in zinc stearate surpasses a particular amount.

When the linear velocity of an image bearing member increases, the charging energy fallen over the image bearing member, AC charging energy in particular, is strong. Thus, the protective agent layer on the image bearing member is desired to be thick to increase the protective effect on the image bearing member by the protective agent.

Zinc stearate is more stably attached to the surface of the image bearing member in a state of 2 molecules than at random. Thus when zinc stearate is applied to the surface of the image bearing member, the thickness of zinc stearate thereon is saturated by only 2 molecules of zinc sterate. When zinc palmitate having a slightly shorter molecule length than zinc stearate is contained in at least a particular amount, the height of the molecule layer is not constant and thus the high portion and low portion coexist. The next molecule slips into the low portion to form a molecule layer. Consequently, a protective agent layer having a thickness greater than 2 molecule thickness of zinc stearate, which results in improvement on the protection effect on the image bearing member. Naturally, when the content of zinc palmitate is excessive, the 2 molecule layer of zinc palmitate tends to be formed and thus the protective agent layer is not thickened. To the contrary, the protection effect on the image bearing member deteriorates in comparison with the sole use of zinc stearate since the molecule of zinc palmitate is smaller than that of zinc stearate.

According to the intensive studies described above, the present inventors have made the present invention. That is, the present invention provides an image forming apparatus including an image bearing member that bears a latent electrostatic image on the surface thereof, a charging device that uniformly charges the surface of the image bearing member, an irradiation device that irradiates the surface of the image bearing member to form the latent electrostatic image, a development device that develops the latent electrostatic image on the surface of the image bearing member with toner to form a toner image thereon, a transfer device that transfers the toner image to a transfer body, a cleaning device including a cleaning blade that removes residual toner remaining on the surface of the image bearing member with the cleaning blade, and a protective agent application device that applies a protective agent including zinc stearate and zinc palmitate to the surface of the image bearing member. In addition, the ratio of the zinc stearate and the zinc palmitate is from 66:34 to 40:60 by weight.

The protective agent for use in the image forming apparatus of the present invention is mainly formed of zinc stearate and zinc palmitate. The weight ratio of zinc stearate to zinc palmitate is from 66:34 to 40:60 and preferably from 65:35 to 45:55. A content of zinc stearate that is too large tends to cause covering all over the image bearing member by the protective agent to be difficult in the case of high linear velocity image formation as in the sole use of zinc stearate. When the content of zinc stearate is too small, the layer thickness of the protective agent tends to be thin, which reduces the protection effect of the protective agent.

In addition, the present inventors further studied the cover ratio when such a mixture is applied and found out the following.

The ratio of the number of Zn atoms contained in zinc stearate ($C_{36}H_{70}O_4Zn$) to the number of all the atoms except for hydrogen atoms contained in zinc stearate is 2.44% (1/41×100). The reason why the hydrogen atom is excluded is that hydrogen is not detected by the XPS analysis. According to this, when pure zinc stearate (no mixture) is sufficiently applied to an image bearing member, the detection ratio of Zn obtained by the XPS analysis is 2.44%. On the other hand, the ratio of the number of Zn atoms contained in zinc palmitate ($C_{32}H_{62}O_4Zn$) to the number of all the atoms except for hydrogen atoms contained in zinc palmitate is 2.70% (1/37×100). When a mixture of zinc stearate and zinc palmitate is sufficiently applied to an image bearing member, the Zn atom number ratio is obtained from the following relationship.

$$\text{Zn atom number ratio} = (2.44 \times \text{ratio of zinc stearate}) + (2.70 \times \text{zinc palmitate})$$

The Zn atom detection ratio obtained by the XPS analysis varies according to the mixture ratio. The protective agent applied is assumed to be free from deterioration due to charging or abrasion. Also, the covering easiness of the zinc stearate and zinc palmitate is assumed to be unchanged. Furthermore, the image bearing member is assumed to be completely covered by the protective agent with no exposed portion.

However, zinc stearate and zinc palmitate are degraded by oxidization due to charging, etc. so that the carbon chains are severed, which thus reduces the number of carbon atoms contained in carboxylic acid, or the carbon chains completely disappear, which leads to remaining of zinc oxide on the image bearing member. In this way, the number of carbon atoms decreases depending on degradation by oxidization. As a result, the oxidized degraded material of the protective agent attached to the image bearing member can be a mixture of various kinds of metal (Zn) soaps of zinc stearate, zinc palmitate and others. Therefore, it is not possible to obtain the ratio of the number of Zn atoms to all the atoms excluding hydrogen atoms. Furthermore, as the linear velocity of the image bearing member increases, which causes the degree of oxidization deterioration greater, the number of carbon atoms decreases. Thus, the factors of degrading the protective agent affect an increase in the ratio of Zn.

The ratio of the number of Zn atoms to the number of all the atoms except for hydrogen atoms is found to vary depending on the degree of deterioration of the metal soap (protective agent). Particularly, when the linear velocity of the image bearing member is high and the oxidization deterioration due to AC charging is significant, the ratio of Zn does not saturate unlike what is described in JOP 2004-198662. Therefore, since the ratio of Zn does not saturate, at what ratio zinc stearate, zinc palmitate, or degraded metal soap covers the image bearing member is not obtained by detection of Zn by XPS. In addition, while the linear velocity is slow, the error contained in the calculated cover ratio does not make a significant problem. However, as the linear velocity of the image bearing member increases, the energy of AC charging is high so that it is found that the actual cover ratio of a protective agent on the image bearing member needs to be at least 90%.

The present inventors have studied about tracing the component contained only in the image bearing member instead of the component contained in the protective agent to obtain an indicator by which the amount of metal soap functioning as the protective agent is figured out even when the metal soap deteriorates because of charging, abrasion, etc. If the value of such an indicator relating only to the component contained only in the image bearing member declines when the protective agent is applied thereto, it means that the protective agent covers the image bearing member. Therefore, the present inventors studied analysis methods suitable to trace the component contained only in the image bearing member in detail. Consequently, with regard to an image bearing member containing a polycarbonate resin before image formation, the peak deriving from the polycarbonate is detected in the range of 290.3 to 294 eV in C1s spectrum. However, the peak detected in the same range after application of metal soap (protective agent) is weak in intensity or zero (not detected). Furthermore, with regard to the peak obtained by separating waveforms produced due to different bonding statuses of carbon atoms according to binding energy, when the ratio $A_0$ of the sum of the peak area having a peak top in the range of from 290.3 to 294 eV to the total area of the entire C1s spectrum is compared with the ratio A obtained after application of protective agent measured in the same manner as in $A_C$, the ratio A is found to be smaller than $A_0$. In addition, an image forming apparatus having an image bearing member having a ratio of A to $A_0$ equal to or smaller than a particular value is found to maintain an excellent durability over an extended period of time.

The peak means a curve represented by Gaus function, or Lorenz function and the peak top means the top of the curve. The functions used are not limited to Gaus function, or Lorenz function and functions suitable for waveform separation such as complex functions of Gaus function, and Lorenz function can be used. The peaks detected in the range of from 290.3 to 294 eV derive from carbonate bonding in a polycarbonate resin, a charge transport material (CTM) or a benzene ring in the polycarbonate resin in the $\Pi-\Pi^*$ electron transition status. The decrease or disappearance of the peak obtained in the range of from 290.3 to 294 eV is deducted to happen when the metal soap protective agent covers the surface of the image bearing member and reduces the exposed portion thereof. Therefore, the degree of the exposure of the image bearing member can be determined by the decrease ratio of the peak area obtained in the range of from 290.3 to 294 eV to the total peak areas of the entire C1s spectrum. By using this method, the cover ratio of the metal soap functioning as the protective agent is calculated by the degree of the exposure of the image bearing member even when the metal soap is degraded due to charging, abrasion, etc.

Therefore, an image forming apparatus having an excellent durability can be provided over an extended period of time.

That is, the image forming apparatus has an image bearing member containing polycarbonate on the uppermost surface layer; an application device that applies a mixture of zinc stearate and zinc palmitate; a charging device that uniformly charges the image bearing member; a development device that develops a latent electrostatic image formed on the surface of the image bearing member according to irradiation from outside with a development agent containing at least toner to form a toner image; a cleaning device that removes residual toner on the surface of the image bearing member after transfer of the toner image to a transfer medium, etc. With respect to C1s spectrum detected by XPS analysis before the mixture of zinc stearate and zinc palmitate is applied and the peak obtained by separating the waveforms deriving from different bonding statuses of carbon atoms according to the binding energy, the image bearing member has a ratio $A_0$(%) of the total area of the peak having a peak top in the range of from 290.3 to 294 eV to the total area of the entire C1s spectrum of at least 3% (However, since A or $A_0$ has en error of about 1.5% due to the detection error, preferably at least 4% and more preferably at least 5%). With respect to Cls spectrum of the image bearing member detected by XPS analysis after 500 images are output while applying the mixture of zinc stearate and zinc palmitate and the peak obtained by separating the waveforms deriving from different bonding statuses of carbon atoms according to the binding energy, when A (%) represents the total area of the peak having a peak top in the range of from 290.3 to 294 eV to the total area of the entire C1s spectrum, the image forming apparatus uses the image bearing member that satisfies the following relationship: $(A_0-A)/A_0\times100\geqq90$.

The cover ratio represented by the relationship: $\{(A_0-A)/A_0\times100\}$ with regard to the image forming apparatus of the present invention is at least 90%, preferably at least 92%, and furthermore preferably at least 95%. When the cover ratio is too small, the protection effect on the image bearing member tends to be not sufficient when the linear velocity of the image bearing member is fast.

Naturally, the cover ratio is preferably at least 90% when less than 500 images are formed. However, the cover ratio increases until 500 images are formed and thereafter is significantly stable. Thus, the cover ratio at 500th image is defined. The cover ratio is at least 90% for 501th or later images until the working life of the image bearing member ends. When the image bearing member is used longer than the working life thereof, the cover ratio of the image bearing member is out of the definition of the present invention.

Figure 5:
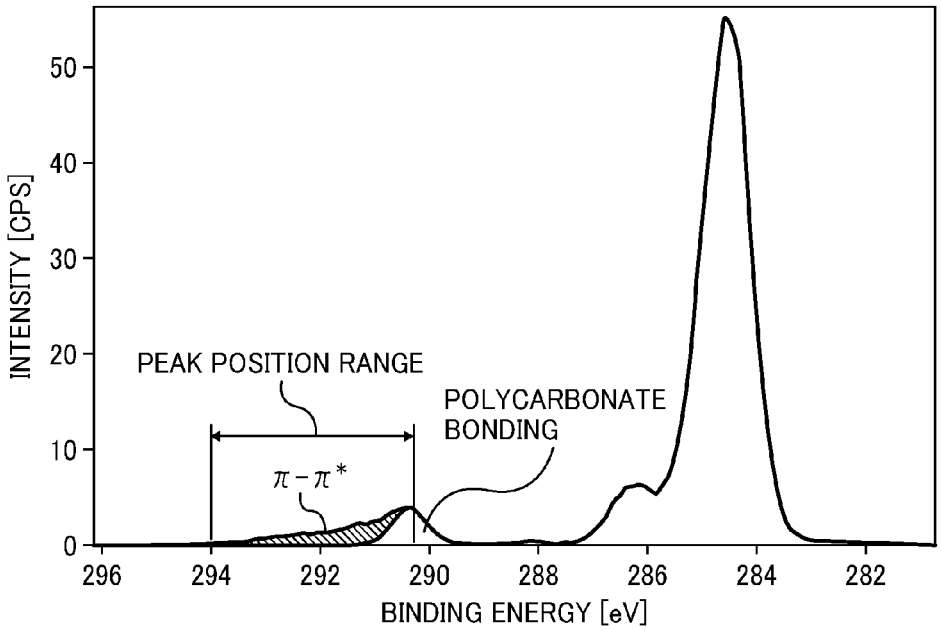
FIG. 5 is a graph illustrating an intensity distribution of binding energy on the surface of the image bearing member for use in the present invention before the protective agent is applied according to XPS analysis.
Figure 6:
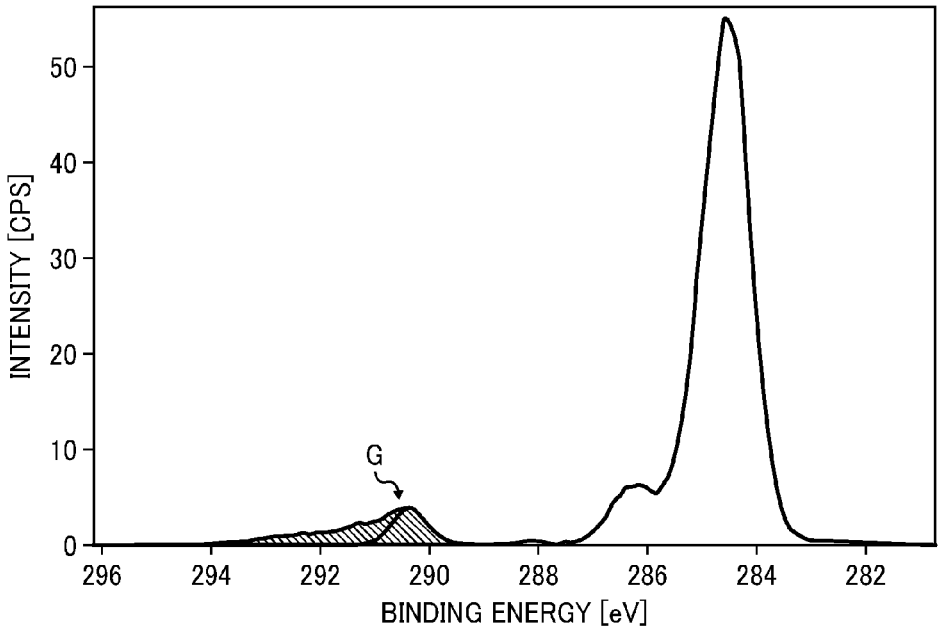
FIG. 6 is a diagram illustrating a spectrum waveform G in the range of from 290.3 to 294 eV for FIG. 5.
Figure 7:
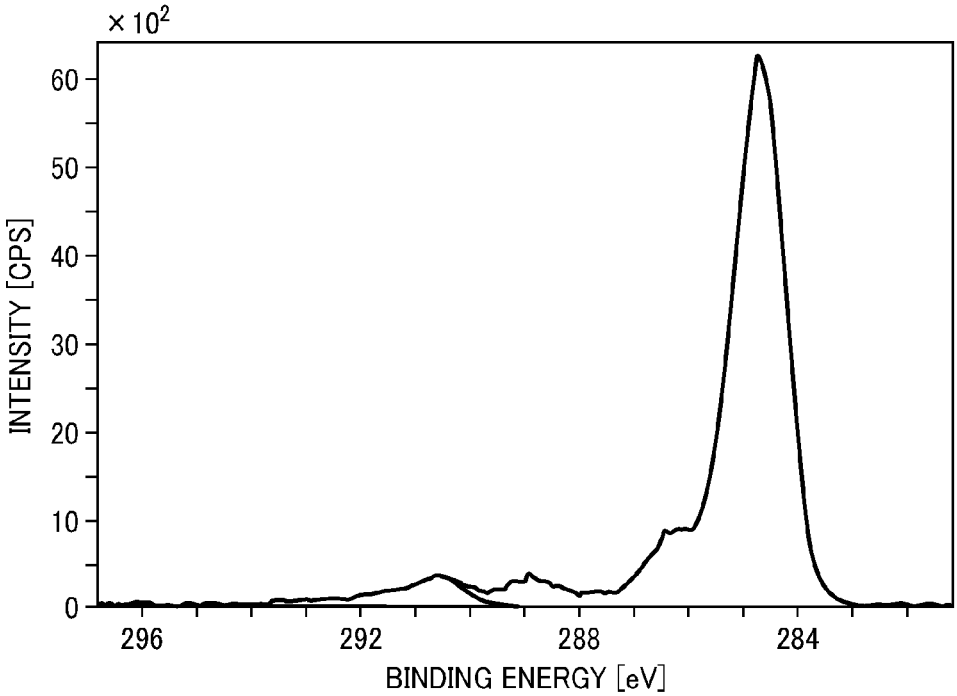
FIG. 7 is a graph illustrating an intensity distribution of binding energy on the surface of the image bearing member for use in the present invention after the protective agent is applied according to XPS analysis.
Figure 8:
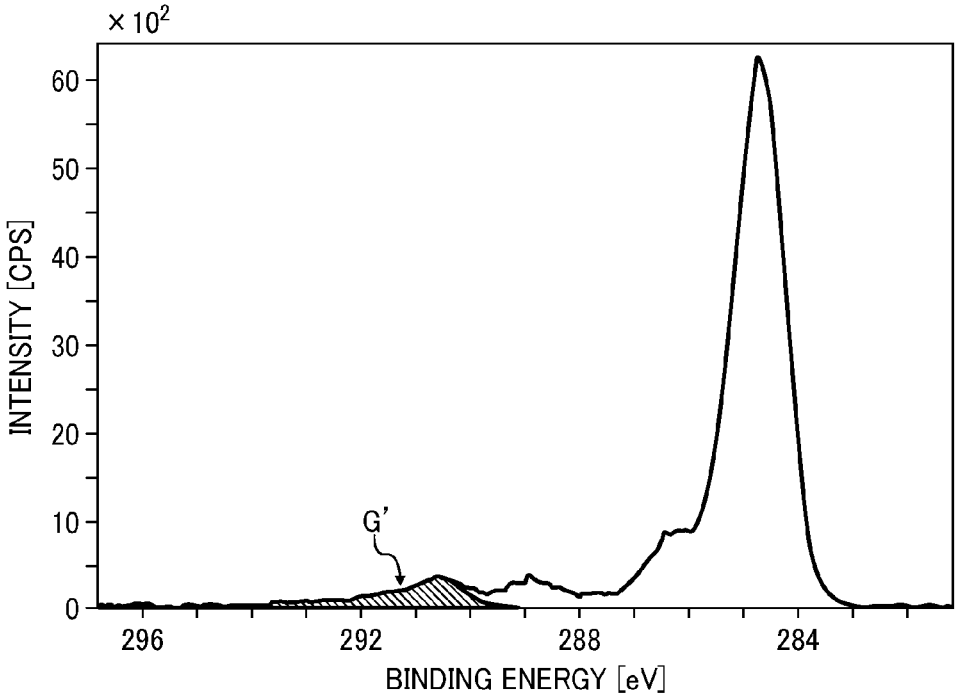
FIG. 8 is a diagram illustrating a spectrum waveform G in the range of from 290.3 to 294 eV for FIG. 6.

FIGS. 5 to 8 represent diagrams illustrating the intensity distribution of the binding energy by XPS analysis on the surface of an image bearing member before and after the protective agent is applied. FIGS. 5 and 6 represent the diagrams before the protective agent is applied and FIGS. 7 and 8 represent the diagrams after the protective agent is applied. FIG. 7 represents a diagram illustrating an example when the cover ratio is 29%.

FIGS. 5 and 6 represent the same spectrum and FIG. 5 is redrawn as FIG. 6 so as to make it suitable to describe G described later. FIGS. 7 and 8 represent the same spectrum and FIG. 7 is redrawn as FIG. 8 so as to make it suitable to describe G' described later.

The methods of obtaining $A_0$ and A are described with reference to FIGS. 5 and 7. First, $A_0$ according to C1s spectrum illustrated in FIG. 5 before the protective agent is applied is described. The C1s spectrum represents the spectrum covering the range of from 281 to 296 eV in FIG. 5. There are typically two methods for calculating the total area of C1s spectrum. One is to separate all the peaks in the spectrum, obtain the areas thereof and sum them up. The other is to calculate the area as one piece. The method of treating the spectrum as one piece is more accurate and time-saving because there is no need to separate the peaks. The total area of the C1s spectrum obtained using an either method before the protective agent is applied is hereinafter referred to as $Y_0$.

As illustrated in FIG. 5, the peaks detected in the range of from 290.3 to 294 eV (peak top) for use in calculation of $A_0$ are separated into the peaks deriving from carbonate bondings (the area adjacent on the right-hand side to the oblique lined area in FIG. 5), and the peaks deriving from π–π* transition (the oblique lined area in FIG. 5). The area of the peaks deriving from π–π* transition are formed of overlapped multiple peaks. Therefore, the total area $W_0$ (before the protective agent is applied) of the peaks detected in the range of from 290.3 to 294 eV (peak top) are obtained by separating the peaks into respective peaks, obtaining the respective areas thereof, and summing up the areas. As illustrated in FIG. 5, the total area $W_0$ can be calculated without separating the waveforms in the range of from 290.3 to 294 eV (peak top) as one piece only when the peaks detected in the range of from 290.3 to 294 eV are not overlapped with the skirts of the peaks in the range of less then 290.3 eV (peak top) or more than 294 eV (peak top).

When the areas $Y_0$ and $W_0$ are calculated, A is obtained by the calculation based on the following relationship.

$$A_0 = W_0/Y_0 \times 100$$

In the case of FIG. 5, $A_0$ is 8.7%.

Similarly, how to obtain A is described based on C1s spectrum of FIG. 7 after the protective agent is applied. As described above, the C1s spectrum represents the spectrum covering the range of from 281 to 296 eV in FIG. 7. The method of calculating the total area of the entire C1s spectrum is the same as the method of calculating Y0. That is, there are typically two methods for calculating the total area of C1s spectrum. One is to separate all the peaks in the spectrum, obtain the areas thereof and sum up them. The other is to calculate the area as one piece. The method of treating the entire spectrum as one piece is more accurate and time-saving because there is no need to separate the peaks. The total area of the C1s spectrum obtained using an either method after the protective agent is applied is hereinafter referred to as Y.

The method of calculating A is the same method as used in calculating $A_0$. That is, the peaks detected in the range of from 290.3 to 294 eV (peak top) are separated into the peaks deriving from carbonate bondings, and the peaks deriving from π–π* transition. The area of the peaks deriving from π–π* transition are formed of overlapped multiple peaks. Therefore, the total area W (after the protective agent is applied) of the peaks detected in the range of from 290.3 to 294 eV (peak top) are obtained by separating the peaks into respective peaks, obtaining respective areas thereof, and summing up the areas. As the ratio of metal soap attached to the image bearing member increases, the degree of overlapping of the skirt of the peak deriving from carboxylic acid and the skirt of the peak detected in the range of from 290.3 to 294 eV (peak top) also increases. Therefore, the peaks are separated and the respective areas thereof are obtained followed by sum-up of them. Alternatively, when the waveform (oblique lined portion in FIG. 8) obtained by similarly scaling down the waveform G (oblique lined portion in FIG. 6) of the spectrum in the range of from 290.3 to 294 eV (peak top) before the protective agent is applied is referred to as the waveform G', the waveform G' is reduced to the size of the spectrum detected in the range of from 290.3 to 294 eV (peak top) of FIG. 7 so that the area of the waveform G' can be obtained.

A can be calculated according to the following relationship based on the calculation results of the area Y and the area W.

$$A = W/Y \times 100.$$

According to A and $A_0$ thus obtained, the cover ratio is calculated by the following relationship:

$$(A_0 - A)/A_0 \times 100(\%).$$

In the case of FIG. 7, A is 6.2%.

The protective agent for use in the image forming apparatus of the present invention optionally contains other kinds of metal soaps which can be admixed with zinc stearate and zinc palmitate. However, metal soap having a structure significantly different from that of zinc stearate or zinc palmitate is not preferable because such metal soap disarranges the protection layer of zinc stearate and zinc palmitate formed on an image bearing member. Therefore, metal soap such as zinc soap of fatty acid having 13 to 20 carbon atoms, which has a structure similar to that of zinc stearate or zinc palmitate, is preferable.

In addition, the protective agent for use in the image forming apparatus of the present invention optionally and preferably contains talc and boron nitride which are self-lubricating to maintain the lubricant property of the image bearing member. The content of talc and/or boron nitride based on the total weight of the protective agent is from 1 to 25% by weight, preferably from 2 to 23% by weight and more preferably from 3 to 21% by weight. When the content of talc and/or boron nitride is too small, the self-lubricating property of talc and boron nitride tends not to be demonstrated. Thus, it is no use containing talc and/or boron nitride. When the content of talc and/or boron nitride are too large, talc and/or boron nitride accumulate thickly on the image bearing member, which degrades the sensitivity of the image bearing member.

Furthermore, the protective agent can be admixed with inorganic particulates such as silica, alumina, ceria, zirconia, clay, calcium carbonate, and surface hydrophobized particulates thereof, and organic particulates such as polymethcrylate methyl particulates, polystyrene particulates, silicone particulates, and resin particulates of α-olefin-norbornene copolymer. These particulates themselves do not have protection effect on an image bearing member but an effect to even the protective agent excessively attached to the image bearing member. Among these, alumina is preferable because alumina does not degrade the sensitivity of the image bearing member even when alumina is attached thereto. When alumina is used, the particle diameter thereof is from 0.05 to 2 μm, preferably from 0.10 to 1 μm and more preferably from 0.15 to 0.7 μm.

In addition, amphipathic organic compounds such as surface active agents can be used as an additive to improve affinity between the surface of the image bearing member and the protective agent therefor and assist formation of the protective agent layer.

The amphipathic organic compound significantly changes the surface properties of the main material in some cases. Therefore, the addition amount of the amphipathic organic compound is preferably from about 0.01 to about 3% by weight and more preferably from about 0.05 to about 2% by weight based on the total amount of a protective agent for an image bearing member.

In the image forming apparatus of the present invention, powder of the protective agent described above can be directly supplied to the surface of the image bearing member. However, a method in which a brush, etc. is pressed against the protective agent processed to have a block form to obtain powder is preferable in terms of storing of the protective agent, simplicity of the protective agent application device and uniform supply of the protective agent.

The protective agent block of the present invention which is mainly formed of zinc stearate and zinc palmitate is manufactured by compacting molding or melting molding.

In the compacting molding, powder mainly containing zinc stearate and zinc palmitate is mixed and the powder mixture is placed in the molding form followed by compression. Powder of zinc stearate and powder of zinc palmitate separately mixed can be used. However, since the size of each powder particle is within a particular range, portions containing zinc stearate in a large amount and portions containing zinc palmitate in a large amount tend to be formed on an image bearing member, which is not preferred. Thus, particles in which zinc stearate and zinc palmitate are compatible are preferably used. Zinc stearate and zinc palmitate can be made to be compatible with each other by, for example, a method in which each material is melted and mixed followed by cooling down and pulverization to obtain compatible powder, or a method in which zinc stearate and zinc palmitate are mixed in a particular ratio followed by a known manufacturing method (dry or wet method) of metal soap in which compatible particles of zinc stearate and zinc palmitate are manufactured. The mixing ratio of stearic acid and palmitic acid in the latter method is almost equal to the mixing ratio of zinc stearate and zinc palmitate. Thus, zinc stearate and zinc palmitate are completely compatible with each other and the productivity and reproducibility thereof are extremely high, which is greatly preferred.

When a protective agent block is formed by compacting molding, the obtained protective agent block has a different hardness depending the degree of compacting. Since the true specific gravity of the protective agent and the amount placed in the molding form are known beforehand, compacting is adjusted such that desired thickness reflecting the degree of compacting is obtained so that the protective agent can be manufactured with good reproducibility.

The degree of compacting the protective agent block is from 88 to 98% and preferably from 90 to 95% based on the true specific gravity of the protective agent. When the compacting degree of the protective agent block is too low, the mechanical strength of the protective agent block tends to be weak so that cracking occurs when handling the protective agent block. A compacting degree of the protective agent block that is too large requires a pressing machine to have a high power and produces partially melted portions, which causes the protective agent to have greatly different hardness depending on portions thereof. This is not preferred.

Fine powder can be made from a protective agent block manufactured by compacting molding in the range of from 88 to 98% of the true specific gravity of the protective agent even when a brush is pressed against the protective agent block under a pressure weaker than in the case of a protective agent block manufactured by melting molding. Therefore, the brush does not deteriorate over a long period of time for the protective agent block manufactured by compacting molding so that the protective agent can be stably supplied to the image bearing member, which is preferred.

When the protective agent block is manufactured by melting molding, zinc stearate and zinc palmitate are melted and mixed and then the melted protective agent is poured into a molding form followed by cooling down.

The obtained protective agent block is attached to a substrate formed of, for example, metal, alloyed metal or plastic by an adhesive, etc., for use.

The ratio of zinc stearate and zinc palmitate in the protective agent of the present invention can be calculated based on the amount of material when the material used is surely known. However, material usually contains impurities. Therefore, the ratio of zinc stearate and zinc palmitate in the manufactured protective agent block is preferably measured by the production lot. The ratio of zinc stearate and zinc palmitate in the protective agent block is obtained as follows: melt the protective agent block in a solution of hydrochloric acid-methanol; heat the solution at 80° C. to methylate stearic acid and palmitic acid; obtain the ratio of stearic acid and the palmitic acid by gas chromatography; and convert the ratio into the ratio of zinc stearate to zinc palmitate.

The protective agent application device for preferable use in the image forming apparatus of the present invention includes a protective agent supply member that supplies the protective agent for the image bearing member to the surface thereof, a pressure application member that presses the protective agent block to be in contact with the protective agent supply member and other optional devices, if desired.

The protective agent application device includes a pressure imparting member that presses a protective agent block to make in contact with the protective agent supply member, a protective agent supply member that supplies a protective agent to the surface of an image bearing member, a protection layer formation member that forms a protection layer by regulating the thickness of the supplied protective agent and optional devices, if desired.

In addition, the protection layer formation member can be used as a cleaning member but preliminarily removing residual including toner on the image bearing member by a cleaning member is preferable to form a protective layer free from the residual.

FIG. 1 is a schematic diagram illustrating an example of the protective agent application device for use in the present invention.

A protective agent application device 2 is provided facing an image bearing member (photoreceptor drum) 1 and includes the protective agent block 21 of the present invention, a protective agent supply member 22, a pressure imparting device 23, a protection layer formation member 24, etc.

The protective agent block 21 of the present invention is brought in contact with, for example, the protective agent supply member 22 having a brush form by a pressure from the pressure imparting member 23. The protective agent supply member 22 rotates and abrades with the image bearing member 1 with each having a different linear velocity from each other. The protective agent held on the surface of the protective agent supply member 22 is supplied to the surface of the image bearing member 1.

The protective agent supplied to the surface of the image bearing member 1 does not sufficiently form a protection layer during supply in some cases. Therefore, the layer of the protective agent is made thin by, for example, the protection layer formation member 24 having a blade form to form a uniform protection layer.

The image bearing member 1 on which the protection layer is formed is subject to charging by discharging at a minute gap between the image bearing member 1 and a charging roller 3 provided in contact with or in the vicinity of the image bearing member 1. A DC voltage or a voltage in which an AC voltage is overlapped with a DC voltage generated by a high voltage power supply (not shown) is applied to the charging roller 3. Due to this charging, part of the protection layer is decomposed or oxidized under the electric stress and in addition, corona products are produced in air and attached to the surface of the protection layer, which results in depleted material.

Figure 2:
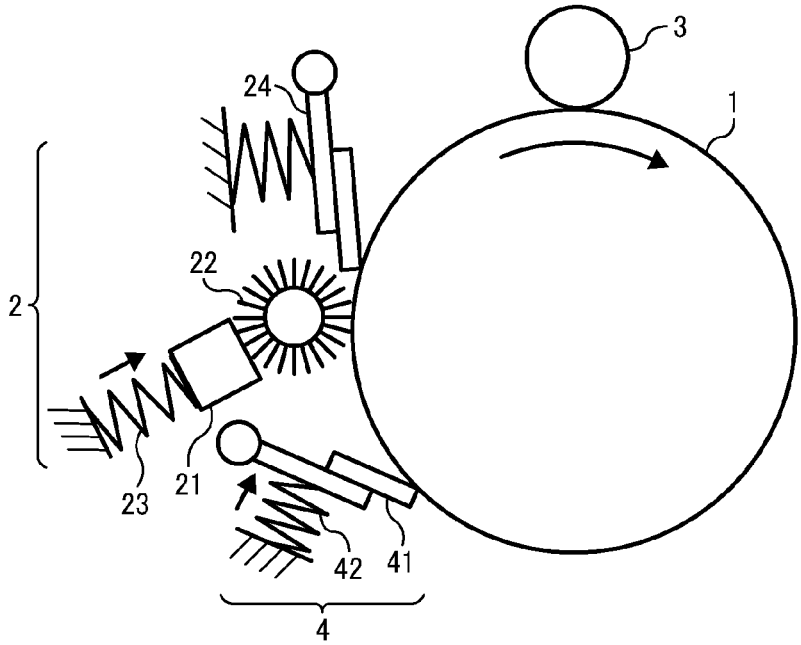
FIG. 2 is a schematic diagram illustrating another example of the protection layer formation device for use in the present invention.

The depleted protective agent is removed together with components of toner, etc. remaining on the image bearing member by a typical cleaning mechanism. The protection layer formation member described above can be used as such a cleaning mechanism. However, separating the function of removing the residual on the image bearing member and the function of forming a protection layer thereon is preferred because the abrasion status of suitable members for respective functions is different in some cases. Therefore, as illustrated in FIG. 2, a cleaning mechanism 4 formed of a cleaning member 41 and a cleaning pressure mechanism 42 is preferably provided on the upstream side of the protection agent supply device 2 relative to the rotation direction of the image bearing member 1.

There is no specific limit to the selection of material for use in the blade for use in the protection layer formation member. Any known blade material can be used. Specific examples thereof include, but are not limited to, urethane rubber, hydrin rubber, silicone rubber, and fluorine containing rubber. These can be used alone or in combination. These blades can be subject to coating or impregnation treatment using material having a low friction coefficient with regard to the contact point with the image bearing member 1. In addition, fillers such as organic fillers and inorganic fillers can be dispersed in the blade to adjust the hardness thereof.

The protection layer formation member can be provided in the counter direction or trailing direction relative to the rotation direction of the image bearing member 1. However, providing the protection layer formation member in the counter direction is more suitable to extend the protective agent on the surface of the image bearing member. Thus, the protective agent is extended quickly even when the linear speed of the image bearing member increases.

The cleaning blade is fixed to a blade support by an arbitrary method using, for example, adhesion or attachment such that the front end of the blade is directly in contact with and pressed against the surface of the image bearing member. The thickness of the blade is not necessarily unambiguously regulated considering the balance between the thickness and the pressure but is preferably from 0.5 to 5 mm and more preferably from 1 to 3 mm.

In addition, the length, i.e., free length, of the cleaning blade which flexibly protrudes from the support is also not necessarily unambiguously regulated considering the balance between the free length of and the pressure but is preferably from 1 to 15 mm and more preferably from 2 to 10 mm.

As other structures of the blade member for use in protection layer formation, a covering layer of resin, rubber, elastomer, etc. is formed on the surface of an elastic metal blade such as a spring board by coating, dipping etc., via a coupling agent or a primer component, if desired, and optionally, thermally cured. The formed layer can be subject to surface grinding treatment, if desired.

The covering layer includes a binder resin and a filing agent with optional components.

There is no specific limit to the binder resin and any can be suitably selected. Specific examples thereof include, but are not limited to, fluorine resins such as PFA, PTFE, FEP, PVdF; fluorine containing rubber; and silicone based elastomers such as methylphenyl silicone elastomer.

The elastic metal blade has a thickness of preferably from 0.05 to 3 mm and more preferably from 0.1 to 1 mm. The elastic metal blade can be subject to treatment such as bending work to cause the blade significantly parallel to the spindle after attachment to prevent distortion of the blade.

The pressure from the protection layer formation member to the image bearing member is sufficient as long as the protective agent is extended to form a protection layer. The linear pressure is preferably from 5 to 80 gf/cm and more preferably from 10 to 60 gf/cm.

A member having a brush form is preferably used as the protective agent supply member. The brush fiber preferably has flexibility to restrain the mechanical stress to the surface of the image bearing member. There is no specific limit to the material for use in the flexible brush fiber and any can be suitably selected. Specific examples thereof include, but are not limited to, polyolefin based resins (e.g., polyethylene and polypropylene); polyvinyl based resin or polyvinylidene based resins (e.g., polystyrene, acryl resin, polyacrylonitrile, polyvinylacetate, polyvinyl alcohol, polyvinyl butyral, polyvinyl chloride, polyvinyl carbazole, polyvinyl ether, and polyvinyl ketone); copolymers of polyvinyl chloride and vinyl acetate; copolymers of styrene and acrylic acid; styrene-butadiene resins; fluorine resins (e.g., polytetrafluoroethylene, polyvinyl fluoride, polyvinylidene fluoride, polychloro trifluoroethylene); polyester; nylon; acryl: rayon; polyurethane; polycarbonate: phenol resin; and amino resin (e.g., urea-formaldehyde resin, melamine resin, benzoguanamine resin, urea resin and polyamide resin).

Dien based rubber, styrene-butadiene rubber (SBR), ethylene propylene rubber, isoplene rubber, nitrile rubber, urethane rubber, silicone rubber, hydrin rubber, norbornene rubber, etc, can be mixed with the brush fiber material specified above to adjust the degree of flexibility (bend).

There are two forms as the support of the protective agent supply member, which are a fixed form and a rotationable roll form. For example, a roll brush formed by winding a tape having pile fabric made from brush fiber around a core metal in a spiral manner can be used as the supply member having a roll form. The brush fiber preferably has a fiber diameter of from about 10 to about 500 μm, a fiber length of from 1 to 15 mm, a brush density of from 10,000 to 300,000 pieces per square inch ($1.5\times10^7$ to $4.5\times10^8$ pieces per square meter).

The protective agent supply member preferably has a high brush density in terms of supply uniformity and supply stability. In addition, one piece of fiber is preferably manufactured from several to several hundreds of pieces of fiber. For example, as in 333 decitex (=6.7 decitex×50 filaments) (=300 denier=6 denier×50 filament), 50 pieces of fine fiber each having 6.7 decitex (6 denier) are bundled and preferably implanted as one piece of fiber.

In addition, a covering layer can be formed on the surface of the brush to stabilize the surface form of the brush or environment stability, if desired. A component which transforms flexibly according as brush fiber bends is preferably used to form the covering layer. There is no limit to selection of the covering layer component as long as the component has flexibility (bending property) and any material can be selected. Specific examples thereof include, but are not limited to, polyolefin resins such as polyethylene, polypropylene, chlorinated polyethylene, and chlorosulfonated polyethyelene; polyvinyl or polyvinylidene resins such as polystyrene, acryl (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; copolymers of vinyl chloride and vinyl acetate; silicone resins or modified products thereof having organosiloxane binding (e.g., modified products of alkyd resins, polyester resins, epoxy resins, or polyurethane resins); fluorine containing resins such as perfluoroalkyl ether, polyfluorovinyl, polyfluorovinylidene, and polychloro trifluoroethylene; polyamides; polyesters; polyurethanes; polycarbonates; amino resins such as urea and formaldehyde resins; epoxy resins; and complex resins thereof.

Since a protective agent can be uniformly applied to the surface of the image bearing member at any linear velocity of the image bearing member for use in the image forming apparatus of the present invention, quality images can be formed over a long period of time. As the linear speed of the image bearing member increases, for example greater than 180 mm/s or 250 mm/s in particular, quality images are difficult to be formed over a long period of time without using the protective agent of the present invention.

Image Formation Method and Image Forming Apparatus

The image formation method related to the present invention includes a latent electrostatic image formation process, a development process, a transfer process, a protection layer formation process, and a fixing process with optional processes such as a cleaning process, a discharging process, a recycling process and a control process.

The image forming apparatus of the present invention include an image bearing member, a latent electrostatic image formation device, a development device, a transfer device, a protective agent application device and a fixing device with optional devices such as a cleaning process, a discharging device, a recycling device and a control device.

The image formation method related to the present invention is suitably performed by the image forming apparatus of the present invention. The latent electrostatic image formation process is performed by the latent electrostatic image formation device. The development process is performed by the development device. The transfer process is performed by the transfer device. The protection layer formation process is performed by the protective agent application device. The fixing process is performed by the fixing device. The other optional processes are performed by the corresponding optional devices.

Latent Electrostatic Formation Process and Latent Electrostatic Static Formation Device The latent electrostatic image formation process is a process of forming a latent electrostatic image on an image bearing member.

Image Bearing Member

There is no specific limit to the image bearing member (also referred to as photoreceptor or photoconductor) with regard to material, form, structure, size, etc. and any known image bearing member can be suitably selected. An image bearing member having a drum form is preferred. Also, an inorganic image bearing member formed of amorphous silicone or selenium and an organic image bearing member formed of polysilane or phthalopolymethine are preferred.

The image bearing member for use in the image forming apparatus of the present invention includes an electroconductive substrate on which a photosensitive layer is provided with optional layers.

The photosensitive layer is typified into a single layer type in which charge generation material and charge transport material are present in a mixed manner, a sequential layer accumulation type in which a charge transport layer is formed on a charge generation layer and a reverse layer accumulation type in which a charge generation layer is formed on a charge transport layer. In addition, an uppermost surface layer can be provided on the photosensitive layer to improve the properties such as the mechanical strength, anti-abrasion property, anti-gas property and cleaning property of the image bearing member. Furthermore, an undercoating layer is provided between the photosensitive layer and the electroconductive substrate. In addition, an agent such as a plasticizer, an anti-oxidant and a leveling agent can be added in a suitable amount to each layer.

There is no specific limit to the selection of material for use in the electroconductive substrate as long as the material has a volume resistance of not greater than $10^{10}$ Ω·cm. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable.

The substrate having a drum form preferably has a diameter of from 20 to 150 mm, more preferably from 24 to 100 mm and particularly preferably from 28 to 70 mm. When the diameter of the drum is too small, physical arrangement of devices performing processes of charging, irradiation, development, transfer, cleaning, etc. around the image bearing member tends to be difficult. A diameter that is too large tends to result in increase in size of the image forming apparatus. In particular, when an image forming apparatus of tandem type is used, a plurality of image bearing members are installed so that the diameter is preferably 70 mm at most and more preferably 60 mm at most. In addition, as described in JOP S52-36016, an endless nickel belt or endless stainless belt can be used as an electroconductive substrate.

The undercoating layer has a single layer structure or a laminar structure and can be formed of, for example, (1) mainly a resin, (2) mainly white pigment and a resin, or (3) oxidized metal film manufactured by chemically or electrochemically oxidizing the surface of the electroconductive substrate. Among these, a mixture of white pigment and a resin is preferred.

Specific examples of the white pigments include, but are not limited to, metal oxides such as titanium oxide, aluminum oxide, zirconium oxide, and zinc oxide. Among these, titanium oxide is preferable in particular in terms of charge infusion prevention from the electroconductive substrate.

Specific examples of the resins include, but are not limited to, thermoplastic resins such as polyamide, polyvinylalcohol, casein, methylcellulose and thermocuring reins such as acryl, phenol, melamine, alkyd, unsaturated polyesters, and epoxy. These can be used alone or in combination.

There is no specific limit to the thickness of the undercoating layer. The undercoating layer preferably has a thickness of from 0.1 to 10 μm and more preferably from 1 to 5 μm.

Specific examples of the charge generation material for use in the photosensitive layer include, but are not limited to, azo pigments such as monoazo-based pigments, bisazo-based pigments, trisazo-based pigments, and tetrakisazo-based pigments; organic-based pigments and dyes such as triaryl methane-based dye, thiazine-based dye, oxazine-based dye, xanthene-based dye, cyanine-based dye, styryl-based dye, pyrylium-based dye, quinacridone-based pigment, indigo-based pigment, perylene-based pigment, polycyclic quinone-based pigment, bisbenzimidazole-based pigment, indanthrone-based pigment, squarylium-baed pigment, and phthalocyanine-based pigment; and inorganic material such as selenium, selenium-arsenic, selenium-tellurium, cadmium-sulfide; zinc oxide; titanium oxide, and amorphous silicone. These can be used alone or in combination.

Specific examples of the charge transport material for use in the photosensitive layer include, but are not limited to, anthracene derivatives, pyrene derivatives, carbazole derivatives, tetrazole derivatives, metallocene derivatives, phenothiazine derivatives, pyrazolline derivatives, hydrazone derivatives, styryl derivatives, styryl hydrazone derivatives, enamine compounds, butadiene compounds, distyryl compounds, oxazole compounds, oxadiazole compounds, thiazole compounds, imidazole compounds, triphenyl amine derivatives, phenylene diamine derivatives, aminostilbene derivatives, and triphenyl amine derivatives. These can be used alone or in combination.

When the charge generation layer or the charge transport layer forms the uppermost surface layer, polycarbonate is used because polycarbonate is transparent to writing light, and has excellent insularity, mechanical strength and adhesiveness.

Thermoplastic resins, thermocuring resins, photocuring resins and photoconductive resins which are known and insulative can be used as the binder resins for use in forming the photosensitive layer. Specific examples of such resins include, but are not limited to, thermoplastic resins such as polyvinyl chloride, polyvinylidene chloride, copolymers of vinyl chloride and vinyl acetate, copolymers of vinyl chloride-vinyl acetate-maleic anhydride, copolymers of ethylene-vinyl acetate, polyvinyl butyral, polyvinyl acetal, polyester, phenoxy resins, (meth)acrylic resin, polystyrene, polycarbonate, polyarylate, polysufone, polyether sulfone, and ABS resins; thermocuring resins such as phenol resins, epoxy resins, urethane resins, melamine resins, isocyanate resins, alkyd resins, silicone resins, and thermocyring acryl resins, polyvinyl carbazole, polyvinyl anthracene and polyvinyl pyrene. These can be used alone or in combination.

Specific examples of the anti-oxidants include, but are not limited to, phenol-based compounds, paraphenylene diamines, organic sulfur compounds, and organic phosphorus compounds.

Specific examples of the phenol compounds include, but are not limited to, 2,6-t-butyl-p-cresol, butylized hydroxyl anisole, 2,6-di-t-butyl-4-ethylphenol, stearyl-β-(3,5-di-t-butyl-4-hydroxyphehyl)propionate, 2,2'-methylene-bis(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydoroxy-5-t-butylphenyl)butane, 1,3,5-rimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl) butylic acid]glycol ester, and tocopherols.

Specific examples of paraphenylene diamines include, but are not limited to, N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Specific examples of hydroquinones include, but are not limited to, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

Specific examples of organic sulfur compounds include, but are not limited to, dilauryl-3,3-thiodipropionate, distearyl-3,3'-thiodipropionate, thiodipropionate, and ditetradecyl-3,3'-thiodipropionate.

Specific examples of organic sulfur compounds include, but are not limited to, triphenyl phosphine, tri(nonylphenyl) phosphine, tri(dinonylphenyl)phosphine, tricresyl phosphine, and tri(2,4-dibutylphenoxy)phosphine.

These compounds are known as anti-oxidants for rubber, plastic, and oils and marketed products thereof can easily be obtained. The addition amount of the anti-oxidants is preferably from 0.01 to 10% by weight based on the total amount of a layer to which the anti-oxidant is added.

Known plasticizers, for example, dibutyl phthalate and dioctyl phthalate, can be used as the plasticizers. Its content is suitably from 0 to about 30% by weight based on 100 parts by weight of the binder resin.

In addition, the photosensitive layer optionally contains leveling agents. Specific examples thereof include, but are not limited to, dimethyl silicone oils and methyl phenyl silicone oils, and polymers or oligomers including a perfluoroalkyl group in their side chain. The content thereof is suitably from 0 to 1 part by weight based on 100 parts by weight of the binder resin.

The uppermost surface layer of the image bearing member is provided to improve the mechanical strength, anti-abrasion property, anti-gas property, cleaning property of the image bearing member. Polymers having a mechanical strength stronger than the photosensitive layer and polymers in which inorganic fillers are dispersed are preferably used to form the uppermost surface. Thermoplastic resins or thermocuring resins can be used as resins for use in the uppermost surface layer. Theremocuring resins are particularly preferred because thermocuring resins have a strong mechanical strength and an extremely good function to restrain the attrition of the image bearing member caused by friction between the image bearing member and a cleaning member. A thin uppermost surface layer causes no problem even without a charge transport power. However, when the thickness of the uppermost surface layer increases without having a charge transport power, problems tend to arise such that the sensitivity of the image bearing member deteriorates, the voltage increases after irradiation, and the residual voltage increases. Therefore, adding the charge transport material specified above to the uppermost surface layer or using a polymer having a charge transport power in the uppermost surface layer is preferred.

Since the mechanical strength is significantly different between the photosensitive layer and the uppermost surface layer, when the uppermost surface layer is abraded and disappears, the photosensitive layer also disappears quickly. Therefore, the uppermost surface layer is desired to have a sufficient thickness and preferably has a thickness of from 0.1 to 12 μm, more preferably from 1 to 10 μm and further preferably from 2 to 8 μm. An uppermost surface layer that is too thin tends to be partially worn down by friction with a cleaning blade so that the attrition of the photosensitive layer easily proceeds from the worn portion. An uppermost surface layer that is too thick tends to cause deterioration of the sensitivity, a voltage increase after irradiation, and a residual voltage rise of the image bearing member. In particular, using a polymer having a charge transport function may lead to a cost increase.

The resins for use for in the uppermost surface layer are preferably transparent to the writing light at image formation and preferably have excellent insularity, mechanical strength and attachment property and polycarbonates, and mixtures or a cross-linking compound of polycarbonate and other polymers are preferable. Specific examples of such resins include, but are not limited to, ABS resins, ACS resins, olefin-vinyl monomer copolymers, chlorinated polyether, aryl resins, phenolic resins, polyacetal, polyamide, polyamideimide, polyallylsulfone, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins. These polymers can be thermoplastic resins. Also, thermocuring resins can be manufactured from the resins by cross-linking with a cross-linking agent having, for example, an acryloyloxy group, a carboxyl group, hydroxyl group, and amino group having multiple functional groups to improve the mechanical strength of the resins. Thereby, the mechanical strength of the uppermost surface layer increases and the attrition of the image bearing member due to friction with a cleaning blade can be significantly reduced.

The uppermost surface layer preferably has a charge transport power. Methods of adding a charge transport power to the uppermost surface layer are, for example, a method in which the polymer for us in the uppermost surface layer is mixed with the charge transport material specified above and a method in which a polymer having a charge transport power is used in the uppermost surface layer. The latter method is preferable because image bearing members manufactured by the latter method are highly sensitive while a voltage increase after irradiation is reduced and a residual voltage rise is also reduced.

The polymers having a charge transport power suitably have a group having a charge transport power represented by the following chemical Structure (i).

Chemical structure (i)

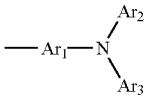

In the Chemical Structure (i), $Ar_1$ represents a non-substituted or substituted arylene group. $Ar_2$ and $Ar_3$ each, independently, represent a non-substituted or substituted aryl group.

The group having such a charge transport power is preferably added to a branch chain of a polymer such as a polycarbonate resin or an acryl resin which has a strong mechanical strength. An acryl resin is particularly preferred because monomers thereof can be easily manufactured and such an acryl resin has good applicability and curing property.

The acryl resin having such a charge transfer power can have good mechanical strength, and excellent transparency by polymerizing an unsaturated carboxylic acid having the group represented by the Chemical Structure (i) to form an uppermost surface layer with high charge transport power. In addition, the acryl resin forms a thermocuring polymer having a cross-linking structure by mixing an unsaturated carboxylic acid having the monofunctional group represented by the Chemical Structure (i) with a multi-functional unsaturated carboxylic acid, preferably three or higher functional unsaturated carboxylic acid, so that the mechanical strength of the uppermost surface layer is extremely strong. The group represented by the Chemical Structure (i) can be added to the multi-functional unsaturated carboxylic acid but using a photocuring multi-functional monomer without adding the group represented by the Chemical Structure (i) is preferable to reduce manufacturing cost.

The monofucntional unsaturated carboxylic acid having the group represented by the Chemical Structure (i) is exemplified by monofunctional unsaturated carboxylic acids represented by the following Chemical Structures (ii) or (iii).

Chemical structure (ii)

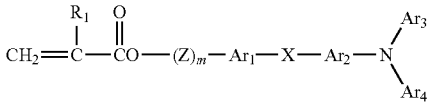

Chemical structure (iii)

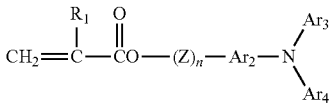

In the Chemical Structures (ii) and (iii), $R_1$ represents hydrogen atom, a halogen atom, a substituted or non-substituted alkyl group, a substituted or non-substituted aralky group, a substituted or non-substituted aryl group, a cyano group, a nitro group, a substituted or non-substituted alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ each, independently, represent hydrogen atom, a halogen atom, a substituted or non-substituted alkyl group, a substituted or non-substituted aralkyl group or a substituted or non-substituted aryl group.

$Ar_1$ and $Ar_2$ each, independently, represent a substituted or non-substituted arylene group, $Ar_3$ and $Ar_4$ each, independently, represent a substituted or non-substituted aryl group, X represents a single bond or a substituted or non-substituted alkylene group, a substituted or non-substituted cycloalkylene group, a substituted or non-substituted alkylene ether group, oxygen atom, sulfur atom or a vinylene group, Z represents a substituted or non-substituted alkylene group, a substituted or non-substituted alkylene ether divalent group or a substituted or non-substituted alkyleneoxy carbonyl divalent group, and m and n each, independently, represent an integer of from 0 to 3.

In the Chemical structures (ii) and (iii), the alkyl group of $R_1$ is, for example, methyl group, ethyl group, propyl group, and butyl group. The aryl group thereof is, for example, phenyl group and naphtyl group. The aralkyl group thereof is, for example, benzyl group, phenthyl group, naphtyl methyl group. The alkoxy group thereof is, for example, methoxy group, ethoxy group and propoxy group. These can be substituted by a halogen atom, nitrogroup, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_1$, hydrogen atom and methyl group are especially preferred.

Specific examples of the aryl group of $Ar_3$ and $Ar_4$ include, but are not limited to, condensed polycyclic hydrocarbon groups, non-condensed ring hydrocarbon groups and heterocyclic groups.

Specific examples of the condensed polycyclic hydrocarbon groups include, but are not limited to, a group which has a ring having 18 or less carbon atoms such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The content of the multi-functional unsaturated carboxylic acids is preferably from 5 to 75% by weight, more preferably from 10 to 70% by weight and furthermore preferably from 20 to 60% by weight based on the entire uppermost surface layer. A content that is too small tends to weaken the mechanical strength of the uppermost surface layer. A content that is too large tends to cause the uppermost surface layer to crack under a strong pressure and degrade the sensitivity thereof.

When the acryl resin is used in the uppermost surface layer, the unsaturated carboxylic acid is applied to the image bearing member followed by electron beam irradiation or activation light beam such as ultraviolet to produce radical polymerization to form the surface layer. A solvent in which a photopolymerization initiator is dissolved in the unsaturated carboxylic acid is used to conduct radical polymerization by active light beam. Material for use in photocuring coating material can be used as the photopolymerization initiator.

The uppermost surface layer preferably contains metal particulates, metal oxide particulates, and other particulates to improve the mechanical strength of the uppermost surface layer. Specific examples of the metal oxides include, but are not limited to, titanium oxide, tin oxide, potassium titanate, TiO, TiN, zinc oxide, indium oxide, and anthimony oxide. Specific examples of the other particulates include, but are not limited to, fluorine resins such as polytetrafluoroethylene, silicone resins, or a mixture in which inorganic material is dispersed in these resins.

Latent electrostatic images are formed by, for example, uniformly charging the surface of the image bearing member and irradiating the surface according to the obtained image information using the latent electrostatic image formation device. The latent electrostatic image formation device includes at least a charger which uniformly charges the surface of the image bearing member, an irradiator which irradiates the surface of the image bearing member according to obtained image information.

The surface of the image bearing member is charged by, for example, applying a voltage to the surface of the image bearing member with the charger.

There is no specific limit to the charger and any known charger can be selected. A known contact type charger having an electroconductive or semi-electroconductive roll, brush, film, rubber blade, etc. and a non-contact type charger such as a corotron, or a scorotron which uses corona discharging can be used.

A charger having a voltage application device such as a charging roller which applies a voltage having an AC component is preferred.

The charging roller employs a contact charging system which contacts the surface of an image bearing member or a vicinity charging system in which the charging roller and the surface of an image bearing member has a gap therebetween. Particularly, when the vicinity charging system is used, toner and other material attached to the image bearing member which have not been removed by cleaning are not easily attached to the charging roller in comparison with the contact charging system. Thus, the vicinity charging system is preferable.

The charging roller for use in the image forming apparatus of the present invention preferably has a layer structure in which a polymer layer and a surface layer are provided on the electroconductive substrate.

The electrconductive substrate functions as the electrode and supporting material of the charging roller and is formed of electroconductive material, for example, metal or alloyed metal such as aluminum, alloy of copper, and stainless steel, electroplated iron with chrome, nickel, etc., and elestroconductive resins.

An electroconductive layer having a resistance of $10^6$ to $10^9$ Ω·cm is preferable as the polymer layer and material in which electroconductive material is admixed with the polymer material to adjust the resistance is suitably used. Specific example of the polymers for use in the polymer layer of the charging roller for use in the image forming apparatus of the present invention include, but are not limited to, thermoplastic elastomers based on polyesters or olefins, polystyrene and styrene based thermoplastic resins such as copolymers of styrene and butadiene, copolymers of styrene and acrylonitrile, copolymers of styrene, butadiene and acrylonitrile, isoplene rubber, chloroplene rubber, epichlorohydrin rubber, butyl rubber, urethane rubber, silicone rubber, fluorine rubber, styrene-butadiene rubber, butadiene rubber, nitrile rubber, ethylene propylene rubber, copolymer rubber of epichlorohydrin-ethyleneoxide, copolymer rubber of epichlorohydrin-ethyleneoxide-arylglycidyl ether, three-dimension copolymer rubber of ethylene-propylene-dien (EPDM), copolymer rubber of acrylonitrile-butadiene, natural rubber and rubber material blended in combination thereof. Among these rubber materials, silicone rubber, ethylene propylene rubber, copolymer rubber of epichlorohydrin-ethyleneoxide, copolymer rubber of epichlorohydrin-ethyleneoxide-arylglycidyl ether, copolymer rubber of acrylonitrile-butadiene, and rubber blend thereof are preferably used. These materials can be foamed and foamed or non-foamed materials are also suitably used.

Electron conductive agents and ion conductive agents are used as the conductive agents. Specific examples of the electron conductive agents include, but are not limited to, fine powder of carbon blacks such as Ketjen black and acethylene black, pyrolytic carbon, graphite, electroconductive metals or alloyed metals such as aluminum, copper, nickel, stainless steel or alloyed metals, electroconductive metal oxides such as tin oxide, indium oxide, titanium oxide, solid dispersion of tin oxide and antimony oxide, solid dispersion of tin oxide and indium oxide, and insulative material the surface of which is electroconductive-treated. In addition, specific examples of the ion electroconductive agents include, but are not limited to, perchlorates or chlorates of tetraethyl ammonium, lauryl trimethyl ammonium, and perchlorates or chlorates of alkali metals or alkali earth metals such as lithium and magnesium. These electroconductive agents can be used alone or in combination. In addition, there is no specific limit to the addition amount thereof but the content of the electron conductive material is preferably from 1 to 30 parts by weight and more preferably from 15 to 25 parts by weight based on 100 parts of a polymer. The content of the ion conductive material is preferably from 0.1 to 5.0 parts by weight and more preferably from 0.5 to 3.0 parts by weight based on 100 parts of a polymer.

As described above, there is no specific limit to the polymer material forming the surface layer as long as the dynamic super microhardness of the surface of the charging roller is from 0.04 to 0.5. Specific examples of the polymer material include, but are not limited to, polyamide, polyurethane, polyvinylidene fluoride, copolymers of tetrafluoroethylene, polyester, polyimide, silicone resins, acryl resins, polyvinyl butyral, copolymers of ethylene tetrafluoro ethylene, melamine resins, fluorine rubber, epoxy resins, polycarbonoate, polyvinyl alcohol, cellulose, polyvinylidene chloride, polyvinyl chloride, polyethylene, and copolymers of ethylene vinyl acetate. Among these, polyamide, polyvinylidene fluoride, copolymers of tetrafluoroethylene, polyester and polyimide are preferred in terms of the releasing property of toner, etc. These polymers can be used alone or in combination. In addition, the average molecular weight of the polymers is preferably from 1,000 to 100,000 and more preferably from 10,000 to 50,000.

The surface layer is formed of a composition (mixture) in which the electroconductive agent for use in the polymer layer and various kinds of particulates are mixed with the polymer specified above. Specific examples of the various kinds of particulates include, but are not limited to, metal oxides and complex metal oxides such as silica, aluminum oxide, and barium titanate, polymer fine powder such as tetrafluoroethylene and vinylidene fluoride. These can be used alone or mixed for use. The thickness of the surface layer is from 0.5 to 12 μm, preferably from 1 to 10 μm and more preferably from 2 to 8 μm.

There is no specific limit to the irradiator as long as the irradiator which irradiates the surface of the image bearing member charged by the charger according to the obtained image information. Specific examples of such irradiation devices include, but are not limited to, a photocopying optical system, a rod lens array system, a laser optical system, and a liquid crystal shutter optical system.

As to the present invention, the rear side irradiation system in which an image bearing member is irradiated from the rear side can be also employed.

Development Process and Development Device

The development process is a process of forming a visualized image by developing the latent electrostatic image with toner or a development agent.

The visualized image is formed by, for example, developing the latent electrostatic image with toner or a development agent by the development device.

There is no specific limit to the development device as long as the development device develops latent electrostatic image with the toner or the development agent and any known development device can be used. For example, a development agent which accommodates and applies the toner or the development agent to the latent electrostatic image in a contact or non-contact manner is suitably used.

Toner

The toner has an average circularity of preferably from 0.93 to 1.00 and more preferably from 0.95 to 0.99, which is the average of the circularity SR represented by the relationship 1. The average circularity is an indicator of the concavo-convex degree of toner particles and toner particles having perfect sphere has an average circularity of 1.00. As the complexity of the surface form of a toner particle increases, the toner particle has a small average circularity value.

$$\text{Circularity SR}=Cs/Cp \qquad \text{Relationship 1}$$

Cp represents the length of the circumference of the projected image area of a toner particle and Cs represents the length of the circumference of a circle having the same area as that of the projected image area of the toner particle When the average circularity is from 0.93 to 1.00, the surface of the toner particle is smooth and the contact area between toner particles, and toner particles and the image bearing member is small so that the transferability of the toner is good. In addition, since such toner particles do not have an angled portion, the stirring torque of the development agent in the development device is small and driving of the stirring is stable, which leads to no production of abnormal images. In addition, there are no angular toner particles which form a dot. Therefore, when the toner particles are pressed against a recording medium during the transfer process, the pressure is uniformly applied to the toner particles, which prevents formation of hollow portions. In addition, the toner particle is not angular, the toner particle itself hardly grinds, damages or abrades the surface of the image bearing member.

The circularity SR can be measured by a flow type particle image analyzer FPIA-1000 manufactured by SYSMEX CORPORATION.

The specific measuring procedure is as follows:

(1) a surfactant serving as a dispersant, preferably 0.1 to 5 ml of an alkylbenzenesulfonic acid salt, is added to 100 to 150 ml of water from which solid impurities have been removed;

(2) 0.1 to 0.5 g of a sample to be measured is added into the mixture prepared in (1);

(3) the mixture prepared in (2) is subjected to an ultrasonic dispersion treatment for about 1 to 3 minutes such that the concentration of the particles is 3,000 to 10,000 particles per microlitter; and (4) the form and particle size of the sample are determined using the instrument mentioned above.

The weight average particle diameter (D4) of the toner is preferably from 3 to 10 μm and more preferably from 4 to 8 μm. In this range, the dot representability is excellent because toner particles have a particle diameter sufficiently small for a minute latent dot. When the weight average particle diameter (D4) is too small, problems arise such that the transfer efficiency tends to deteriorate, and the cleaning property of a cleaning blade deteriorates. When the weight average particle diameter (D4) is too large, reducing splattering of characters or lines tends to be difficult.

The toner has a ratio (D4/D1) of the weight average particle diameter (D4) to the number average particle diameter (D1) of preferably from 1.00 to 1.40 and more preferably from 1.00 to 1.30. As the ratio (D4/D1) approaches to 1, the particle size distribution of the toner is sharp. In the preferable range, since selective development caused by the toner particle diameter does not occur, the image quality is stable. In addition, since the particle size distribution of the toner is sharp, the distribution of the amount of friction charge is also sharp, which leads to prevention of occurrence of fogging. Furthermore, when the toner particle size is within a small range, toner particles are orderly and densely arranged to develop an image so that the dot representability is excellent.

The weight average particle diameter (D4) and the particle size distribution of the toner particles can be measured by Coulter counter method, etc. For example, Coulter Counter TA-II and Coulter Multisizer II (both are manufactured by Beckman Coulter, Inc.) can be used as the measuring equipment. The measuring method is as follows:

First, add 0.1 to 5 ml of a surface active agent (preferably alkylbenzene sulfonic salt) as a dispersant to 100 to 150 ml of an electrolytic aqueous solution, which is about 1% NaCl aqueous solution prepared by using primary NaCl and pure water, for example, ISOTON-II (manufactured by Beckman Coulter, Inc.) can be used; Add 2 to 20 mg of a measuring sample of solidified toner to the electrolytic aqueous solution; Conduct dispersion treatment for the electrolytic aqueous solution in which the measuring sample is dispersed for about 1 to 3 minutes by an ultrasonic dispersion device; Measure the volume and the number of the toner particles or the toner by the equipment mentioned above with an aperture of 100 μm; and calculate the volume distribution and the number distribution. The weight average particle diameter (D4) and the number average particle diameter (D1) of the toner can be obtained based on the obtained distributions.

The toner having such a significantly round form can be manufactured by dispersing or emulsifying droplets (oil phase) of toner compositions containing a polyester prepolymer having a functional group having a nitrogen atom, a polyester, a coloring agent, and a releasing agent in an aqueous medium to obtain a liquid dispersion of emulsion followed by cross-linking reaction and/or elongation reaction under the presence of resin particulates. The toner prepared in this reaction can reduce the occurrence of hot offset by hardening the surface of the toner, which reduces contamination of the fixing device and its reflection on images.

An example of the prepolymer formed of the modified polyester based resin is a polyester prepolymer (A) having an isocyanate group and an example of the compound that elongates or cross-links with the prepolymer is an amine (B).

The polyester prepolymer mentioned above can be prepared by, for example, reacting a polyester having an active hydrogen group, which is a polycondensation product of a polyol (1) and a polycarboxylic acid (2), and a polyisocyanate (3). Specific examples of the active hydrogen group contained in the polyester mentioned above including the mentioned above include, but are not limited to, hydroxyl groups (alcohol hydroxyl groups and phenol hydroxyl groups), amino groups, carboxylic groups, and mercarpto groups. Among these, alcohol hydroxyl groups are particularly preferred.

Examples of the polyol (1) are diol (1-1) and polyol (triol or higher polyol) (1-2) and using diol (1-1) or a mixture of diol (1-1) with a small amount of (1-2) is preferred.

Specific examples of the diols (1-1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (1-2) include, but are not limited to, aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include, but are not limited to, dicarboxylic acids (2-1) and polycarboxylic acids (2-2) having three or more carboxyl groups. Among these, using the dicarboxylic acid (2-1) alone or a mixture of the dicarboxylic acid with a small amount of polycarboxylic acid (2-2) is preferred.

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include, but are not limited to, aromatic polycarboxylic acids having from 9 to 20 carbon atoms (e.g., trimellitic acid and pyromellitic acid).

In addition, compounds prepared by reaction between anhydrides or lower alkyl esters (e.g., methyl esters, ethyl esters or isopropyl esters) of the polycarboxylic acids mentioned above and polyols (1) can be used as the polycarboxylic acid (2).

A suitable mixing ratio (i.e., an equivalence ratio [OH]/[COOH]) of a polyol (1) to a polycarboxylic acid (2) is from 2/1 to 1/1, preferably from 1.5/1 to 1/1, and more preferably from 1.3/1 to 1.02/1.

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination.

A suitable mixing ratio (i.e., [NCO]/[OH]) of the polyisocyanate (3) to a polyester having a hydroxyl group is from 5/1 to 1/1, preferably from 4/1 to 1.2/1 and more preferably from 2.5/1 to 1.5/1 in equivalent ratio. When the [NCO]/[OH] ratio is too large, the low temperature fixability of the toner tends to deteriorate. When the molar ratio of [NCO] is too small, the urea content of urea-modified polyesters in the modified polyesters tends to be small, which leads to deterioration of the hot offset resistance.

The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. A content that is too low easily degrades the hot offset resistance of the toner and disadvantageous in terms of having a good combination of high temperature preservability and low temperature fixing property. In contrast, when the content is too high, the low temperature fixing property tends to deteriorate.

The number of isocyanate groups included in the prepolymer (A) per molecule is normally not less than 1, preferably from 1.5 to 3, and more preferably from 1.8 to 2.5. When the number of isocyanate groups is too small, the molecular weight of urea-modified polyester tends to be small and the hot offset resistance easily deteriorates.

Specific examples of the amines (B) include, but are not limited to, diamines (B1), polyamines (B2) having three or more amino groups, amino alcohols (B3), amino mercaptans (B4), amino acids (B5), and blocked amines (B6) in which the amines (B1) to (B5) mentioned above are blocked.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine, and hexamethylene diamine); etc.

Specific examples of the polyamines (B2) having three or more amino groups include, but are not limited to, diethylene triamine, and triethylene tetramine.

Specific examples of the amino alcohols (B3) include, but are not limited to, ethanol amine and hydroxyethyl aniline.

Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid.

Specific examples of the blocked amines (B6) include, but are not limited to, ketimine compounds which are prepared by reacting one of the amines (B1) to (B5) mentioned above with a ketone such as acetone, methyl ethyl ketone and methyl isobutyl ketone; oxazoline compounds, etc.

Among these, (B1) and a mixture of (B1) with a small amount of (B2) are preferred.

Furthermore, the molecular weight of the urea-modified polyesters can be adjusted by using a molecular weight control agent. Specific preferred examples of the molecular weight control agent include, but are not limited to, monoamines (e.g., diethyl amine, dibutyl amine, butyl amine and lauryl amine) having no active hydrogen group, and blocked amines (i.e., ketimine compounds) prepared by blocking the monoamines mentioned above.

The mixing ratio of the isocyanate group to the amines (B), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea-modified polyester (i) decreases, resulting in deterioration of the hot offset resistance of the resultant toner.

In the present invention, the urea-modified polyester (i) may contain a urethane bonding in addition to the urea bonding. The molar ratio of the content of the urea bonding to the content of the urethane bonding is preferably from 100/0 to 10/90, more preferably from 80/20 to 20/80 and further preferably from 30/40 to 30/0. When the molar ratio of the urea bonding is too small, the anti-hot offset property tends to deteriorate.

By the reaction specified above, modified polyesters for use in the toner, for example, the urea-modified polyester (i) is manufactured. This urea-modified polyester (i) is manufactured by the one-shot method or a prepolymer method. The weight average molecular weight of the urea-modified polyester (i) is preferably 10,000 or higher, more preferably from 20,000 to 10,000,000 and further preferably from 30,000 to 1,000,000. When the weight average molecular weight is too small, the anti-hot offset property tends to deteriorate.

The number average molecular weight of the urea-modified polyester is not particularly limited when an unmodified polyester (ii), which is described later, is used. The number average molecular weight is controlled to make the weight average molecular weight in the range specified above. When the polyester (i) is singly used, the number average molecular weight is preferably 20,000 or lower, preferably from 1,000 to 10,000 and further preferably from 2,000 to 8,000. When the number average molecular weight is too large, the low temperature fixability of the resultant toner tends to deteriorate, and in addition the gloss of full color images degrades when the toner is used in a full color image forming apparatus.

In the present invention, a combination of the urea-modified polyester (i) with an unmodified polyester (ii) as the component of a binder resin can be used as well as the urea-modified polyester (i) alone. This combinational use is preferable to improve the low temperature fixability of a toner and the gloss property when the toner is used in a full-color image forming apparatus. Examples of the polyester (ii) are polycondensation products of the polyol (1) having the same polyester component specified for the polyester (i) and the polycarboxylic acid (2) and preferred examples are the same as in the case of the polyester (i). In addition, a polyester modified by a bonding (e.g., urethane bonding) other than urea bonding can be used as the polyester (ii). The polyester (i) and the polyester (ii) that are at least partially compatible with each other are preferable in terms of the low temperature fixing property and the anti-hot offset property.

Therefore, the polyester (ii) preferably has a component similar to the polyester component of the polyester (i). The weight ratio of the polyester (i) to the polyester (ii) is from 5/95 to 80/20, preferably from 5/95 to 30/70, more preferably from 5/95 to 25/75 and particularly preferably from 7/93 to 20/80 when the polyester (ii) is contained. A ratio of the polyester (i) that is too small, for example, less than 5%, tends to degrades the hot offset resistance and prevent to have a good combination of the high temperature preservability and the low temperature fixing property.

The peak molecular weight of the polyester (ii) is preferably from 1,000 to 30,000 and more preferably from 1,500 to 10,000 and further preferably from 2,000 to 8,000. When the peak molecular weight is too small, the high temperature preservability tends to deteriorate. When the peak molecular weight is too large, the low temperature fixing property tends to deteriorate. The hydroxyl value of the polyester (ii) is preferably 5 or higher, more preferably from 10 to 120, and further preferably from 20 to 80. A hydroxyl value that is too small may be disadvantageous in terms of having a good combination of the high temperature preservability and the low temperature fixing property. The acid value of the polyester (ii) is preferably from 1 to 30 and more preferably from 5 to 20. The polyester (ii) having an acid value tends to cause the resultant toner to be negatively charged.

The glass transition temperature (Tg) of the binder resin is preferably from 50 to 70° C. and more preferably from 55 to 65° C. A toner that has an excessively low glass transition temperature easily causes blocking when the toner is preserved at a high temperature. When the glass transition temperature is too high, the low temperature fixing property tends to deteriorate. The toner for use in the present invention tends to have a relatively good high temperature preservability at a low glass transition temperature due to the presence of the urea-modified polyester resins in comparison with a known polyester based toner.

With respect to the storage elastic modulus of the toner binder, the temperature (TG') at which the storage elastic modulus is 10,000 dyne/cm$^2$ when measured at a frequency of 20 Hz is not lower than 100° C., and preferably from 110 to 200° C. When the temperature (TG') is too low, the anti-hot offset property tends to deteriorate.

With respect to the viscosity of the toner binder, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner deteriorates. In order to achieve a good combination of the low temperature fixability and the hot offset resistance, the TG' is preferably higher than the Tη. Specifically, the difference (TG'−Tη) is preferably not less than 0, more preferably not less than 10° C., and furthermore preferably not less than 20° C. The difference particularly has no specific upper limit. In order to achieve a good combination of the high temperature preservability and the low temperature fixability, the difference (TG'−Tη) is preferably from 0 to 100° C., more preferably from 10 to 90° C. and furthermore preferably from 20 to 80° C.

The binder resin (toner binder) is manufactured by the following method, etc.

Heat the polyol (1) and the polycarboxylic acid (2) to 150 to 280° C. under the presence of known esterification catalysts such as tetrabuthoxy titanate, dibutyl tin oxide, etc.; remove produced water with a reduced pressure, if necessary, to obtain a polyester having a hydroxyl group; react the polyester with the polyisocyanate (3) at 40 to 140° C. to obtain the prepolymer (A) having an isocyanate group; and furthermore, conduct reaction between the prepolymer (A) and the amine (B) at 0 to 140° to obtain a urea-modified polyester. During the reaction of the polyisocyanate (3) and the prepolymer (A) and the amine (B), a solvent is optionally used.

Examples of such solvents are inert compounds to the isocyanate (3) and specific examples thereof include, but are not limited to, inert compounds to the isocyanate (3) such as aromatic solvents (toluene, xylene); ketones (acetone, methylethyl ketone, methylisobutyl ketone); esters (ethyl acetate); amides (dimethylformamide, dimethylacetamide); and ethers (tetrahydrofuran).

When the polyester (ii) which is not modified by urea bonding is used in combination, the polyester (ii) is prepared by the same method as for the polyester having a hydroxyl group and dissolved in and mixed with the solution of the polyester (i) after the reaction.

The toner for use in the present invention can be manufactured by the following method but is not limited thereto.

The toner can be prepared by reacting a dispersion body formed of the prepolymer (A) having an isocyanate group with the amine (B) in an aqueous medium or using a preliminarily manufactured urea modified polyester (i). The dispersion body formed of the urea-modified polyester (i) or the prepolymer (A) in an aqueous medium can be stably formed by, for example, a method in which a composition of toner material containing the urea-modified polyester (i) and the prepolymer (A) is added to the aqueous medium and dispersed by shearing force.

The prepolymer (A) and other toner compositions (also referred to as toner material) such as a coloring agent, a coloring agent master batch, a releasing agent, a charge control agent, and an unmodified polyester resin can be mixed in an aqueous medium when forming a dispersion body. However, a method in which toner material is preliminarily mixed and then the mixture is added to and dispersed in an aqueous medium is preferable. In addition, in the present invention, a coloring agent, a releasing agent, and a charge control agent, etc. are not necessarily mixed when particles are formed in an aqueous medium but can be added after particles are formed in an aqueous medium. For example, after particulates containing no coloring agent are formed, a coloring agent is added thereto by a known dying method.

Suitable aqueous media is not limited to water only and mixtures of water with a solvent which can be mixed with water are also suitably used. Specific examples of such solvents include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The weight ratio of the toner component including the urea-modified polyester (i) and the prepolymer (A) to the aqueous medium (M) is typically from 100/50 to 100/2,000, and preferably from 100/100 to 100/1,000. When the ratio of the aqueous medium is too small, the dispersion of the toner component in the aqueous medium is not satisfactory, and thereby the resultant toner particles do not have a desired particle diameter. In contrast, a ratio of the aqueous medium that is too large is not preferred in terms of the economy.

A dispersion agent can be optionally used. The particle size distribution is sharp and dispersion is stabilized when a dispersion agent is used.

There is no specific limit to the dispersion method. Specific examples thereof include, but are not limited to, a low speed shearing method, a high speed shearing method, a friction method, a high pressure jet method, an ultrasonic method. Among these methods, the high speed shearing method is preferable because particles having a particle diameter of from 2 to 20 μm can be easily prepared. The particle diameter (2 to 20 μm) means a particle diameter of particles including liquid.

When a high speed shearing type dispersion machine is used, there is no specific limit to the rotation speed, but the rotation speed is preferably from 1,000 to 30,000 rpm, and more preferably from 5,000 to 20,000 rpm. There is no specific limit to the dispersion time but the dispersion time is typically from 0.1 to 5 minutes in the batch system. The temperature during the dispersion process is preferably from 0 to 150° C., and more preferably from 40 to 98° C. A high temperature is preferable during the dispersion process because the dispersion body containing the urea-modified polyester (i) and the prepolymer (A) has a low viscosity, which is advantageous to easy dispersion.

In the process in which the urea-modified polyester (i) is synthesized from the prepolymer (A), the amine (B) can be added to an aqueous medium before the toner component is dispersed therein, or to a liquid dispersion in which the toner component is dispersed in an aqueous medium to start reaction at the particle interface. In the latter case, the urea-modified polyester is preferentially formed at the surface portions of the toner particles. Thus, a gradient of the concentration of the urea-modified polyester can be produced in the thickness direction of the toner particle.

In the reaction, a dispersion agent is preferably used.

There is no specific limit to the dispersion agent and any known dispersion agent can be suitably used. Specific examples thereof include surface active agents, inorganic compound dispersion agents hardly soluble in water, and polymeric protective colloids.

These can be used alone or in combination. Among these, surface active agents are preferred.

For example, anionic surface active agents, cationic surface active agents nonionic surface active agents, and ampholytic surface active agents can be preferably used.

Specific examples of the anionic surface active agents include, but are not limited to, alkylbenzene sulfonic acid salts, α-olefin sulfonic acid salts, and phosphoric acid esters. Among these, surface active agents having a fluoroalkyl group are preferred. Specific examples of the anionic surface active agents having a fluoroalkyl group include, but are not limited to, fluoroalkyl carboxylic acids having 2 to 10 carbon atoms and their metal salts, disodium perfluorooctane sulfonylglutamate, sodium 3-{omega-fluoroalkyl(having 6 to 11 carbon atoms)oxy}-1-alkyl(having 3 to 4 carbon atoms) sulfonate, sodium 3-{omega-fluoroalkanoyl(having 6 to 8 carbon atoms)-N-ethylamino}-1-propanesulfonate, fluoroalkyl (having 11 to 20 carbon atoms) carboxylic acids and their metal salts, perfluoroalkylcarboxylic acids and their metal salts, perfluoroalkyl (having 4 to 12 carbon atoms) sulfonate and their metal salts, perfluorooctanesulfonic acid diethanol amides, N-propyl-N-(2-hydroxyethyl)perfluorooctanesulfone amide, perfluoroalkyl(having 6 to 10 carbon atoms) sulfoneamidepropyltrimethylammonium salts, salts of perfluoroalkyl(having 6 to 10 carbon atoms)-N-ethylsulfonyl glycin, and monoperfluoroalkyl (having 6 to 16 carbon atoms)ethylphosphates.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents include, but are not limited to, amine salt type surface active agents and quaternary ammonium salt type anionic surface active agents. Specific examples of the amine salt type surface active agents include, but are not limited to, alkyl amine salts, amino alcohol fatty acid derivatives, polyamine fatty acid derivatives, and imidazoline. Specific examples of the quaternary ammonium salt type cationic surface active agents include alkyl trimethyl ammonium salts, dialkyl dimethyl ammonium salts, alkyl dimethyl benzyl ammonium salts, pyridinium salts, alkyl isoquinolinium salts, and benzetonium chloride. Among these, primary, secondary and tertiary aliphatic amines having a fluoroalkyl group, aliphatic quaternary ammonium salts such as perfluoroalkyl (having 6 to 10 carbon atoms) sulfoneamide propyltrimethylammonium salts, benzalkonium salts, benzetonium chloride, pyridinium salts and imidazolinium salts. Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

Specific examples of the nonionic surface active agents include, but are not limited to, fatty acid amide derivatives, and polyalohol derivatives.

Specific examples of amopholytic surface active agents include, but are not limited to, alanine, dodecyldi(amino ethyl)glycine, di(octyl amonoethyl)glycine, and N-alkyl-N,N-dimethyl ammonium betaine.

An inorganic compound such as tricalcium phosphate, calcium phosphate, titanium oxide, colloidal silica, and hydroxyapatite can also be used as the inorganic compound dispersant hardly soluble to water.

Specific examples of the polymeric protective colloids include, but are not limited to, acids, (meth) acrylic monomer having a hydroxyl group, vinyl alcohol or ethers thereof, esters of vinyl alcohol and a compound having a carboxylic group, amide compounds or methylol compounds thereof, chlorides, homopolymers or copolymers having a nitrogen atom or a heterocyclic ring thereof, polyoxyethylene based compounds and celluloses.

Specific examples of the acids mentioned above include, but are not limited to, acrylic acid, methacrylic acid, α-cyanoacrylic acid, α-cyanomethacrylic acid, itaconic acid, crotonic acid, fumaric acid, maleic acid and maleic anhydride. Specific examples of the (meth) acrylic monomer mentioned above having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of vinyl alcohols mentioned above or its ethers include vinyl methyl ether, vinyl ethyl ether and vinyl propyl ether. Specific examples of the esters mentioned above of vinyl alcohol and a compound having a carboxylic group include, but are not limited to, vinyl acetate, vinyl propionate and vinyl butyrate. Specific examples of the amide compounds mentioned above or their methylol compounds include, but are not limited to, acrylamide, methacrylamide and diacetone acrylamide acid and their methylol compounds. Specific examples of the chlorides mentioned above include, but are not limited to, acrylic acid chloride and methacrylic acid chloride. Specific examples of homopolymers or copolymers mentioned above having a nitrogen atom or a heterocyclic ring thereof include, but are not limited to, vinyl pyridine, vinyl pyrrolidone, vinyl imidazole and ethylene imine. Specific examples of the polyoxyethylene mentioned above include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the celluloses mentioned above include, but are not limited to, methyl cellulose, hydroxyethyl cellulose and hydroxypropyl cellulose.

A dispersion stabilizer can be optionally used in preparation of the dispersion liquid mentioned above.

Specific examples of the dispersion stabilizers include, but are not limited to, compounds such as calcium phosphate which are soluble in an alkali or an acid.

By such a dispersion stabilizer is used, calcium phosphate can be removed from particulates by a method of washing with water or a method of decomposing with enzyme after dissolving calcium phosphate with an acid such as hydrochloric acid.

When the dispersion liquid mentioned above is prepared, a catalyst for elongation and/or cross-linkage reaction can be used. Specific examples thereof include, but are not limited to, dibutyltin laurate and dioctyltin laurate.

In addition, a solvent in which the urea-modified polyester (i) and the prepolymer (A) can be used to decrease the viscosity of the toner component. Such a solvent is preferable because it is effective to cause the particle size distribution to be sharp. Also, a volatile solvent is preferable because the solvent can be easily removed from liquid dispersion after the particles are formed.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The aromatic solvents such as Toluene and xylene are more preferable.

The addition amount of such a solvent is from 0 to 300 parts by weight, preferably from 0 to 100, and more preferably from 25 to 70 parts by weight, based on 100 parts by weight of the prepolymer (A) used. When such a solvent is used, the solvent is removed therefrom upon application of heat thereto under a normal or reduced pressure condition after the particles are subjected to an elongation reaction and/or a crosslinking reaction.

The crosslinking time and/or the elongation time is determined depending on the reactivity determined according to the combination of the isocyanate group structure of the prepolymer (A) and the amine (B) and is preferably from 10 minutes to 40 hours, and more preferably from 2 to 24 hours. The reaction temperature is preferably from 0 to 150° C., and preferably from 40 to 98° C. In addition, a known catalyst such as dibutyltin laurate and dioctyltin laurate can be optionally used during the reaction.

In order to remove the organic solvent from the thus prepared emulsion (dispersion), a drying method, in which the temperature of the emulsion is gradually raised to evaporate the organic solvent from the drops dispersed in the emulsion, can be used. Alternatively, a drying method in which the emulsion is sprayed in a dry atmosphere to evaporate and remove not only the organic solvent but also the remaining aqueous medium in the drops in the emulsion to form toner particulates can be used. The dry atmosphere can be prepared by heating gases such as air, nitrogen, carbon dioxide and combustion gases. Particularly, various kinds of air streams which have been heated to a temperature higher than the highest boiling point of the solvents used in the emulsion are typically used. The drying treatment up to the required quality is prepared in a short period of time by using a drying device such as a spray dryer, a belt dryer, a rotary kiln, etc.

When the thus prepared toner particles have a wide particle diameter distribution even after the particles are subjected to a washing treatment and a drying treatment, the toner particles can be subjected to a classification treatment so that the toner particles have a desired particle diameter distribution.

The classification operation can be performed in a liquid dispersion using a cyclone, a decanter, or a centrifugal to remove fine particles therefrom. Classification can be performed after the toner particles are dried but preferably in the liquid including the particles in terms of the efficiency. The toner particles having an undesired particle diameter can be returned to the kneading process for reuse even when the toner particles are in a wet condition.

Removing the dispersion agent from the liquid dispersion as much as possible is preferable and is preferably conducted together with the classification process.

The thus prepared toner powder particles can be mixed with other fine particles such as release agent particles, charge control agent particles, fluidizing agent particles and coloring agent particles. Such fine particles can be fixed on the surface of the toner particles by applying a mechanical impact thereto while the particles and toner particles are integrated. Thus, the fine particles can be prevented from being detached from the toner particles.

Specific examples of such mechanical impact application methods include, but are not limited to, methods in which a mixture is mixed with a highly rotated blade and methods in which a mixture is put into a jet air to collide the particles against each other or a collision plate.

Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

In addition, known pigments and dyes for used in coloring agents for toner can be used and specific examples thereof include, but are not limited to, carbon black, lamp black, black iron oxide, indigo, Nigrosine dyes, aniline blue, phthalocyanine blue, phthalocyanine green, Hansa Yellow GR, rhodamine 6C lake, Calco oil blue, chrome yellow, Quinacridone Red, Benzidine yellow, and rose Bengal. These can be used alone or in combination.

The toner optionally contains magnetic components of iron oxides such as ferrite, magnetite, maghematite, metals such as iron, cobalt, and nickel, or alloyed metal of these metals and other metals alone or mixed with each other to have magnetic characteristics in the toner itself. These magnetic components can be used as coloring agent components.

The number average particle diameter of the coloring agent in the toner for use in the present invention is preferably from 0.5 μm or smaller, more preferably from 0.4 μm or smaller, and from 0.3 μm or smaller. When the number average particle diameter is excessively large, the dispersion property of the pigment tends to be insufficient so that desirable transparency might not be obtained. Coloring agent particles having a number average particle diameter smaller than 0.1 μm is sufficiently small in comparison with a half wavelength of optical light and is thus considered to have no adverse impact on the characteristics of light on reflectivity or absorption characteristics. Therefore, coloring agent particles having a number average particle diameter smaller than 0.1 μm contributes to improve color representability and transparency for a transparent sheet having a fixed image. On the other hand, when coloring agent particles having a number average particle diameter greater than 0.5 μm are contained in a large amount, the incident light does not easily transmit or is scattered so that the lightness and the colorness of projected images of transparent sheets tend to deteriorate. Furthermore, the coloring agent is easily detached from the surface of the toner particle, which leads to problems such as fogging, contamination of the drum, bad cleaning performance. The content ratio of coloring agents having a number average particle diameter larger than 0.7 μm is not preferably greater than 10% by number and more preferably 5% by number.

In addition, when the coloring agent is mixed and kneaded with part or all of binder resin and a preliminarily added moistening liquid, the binder resin and the coloring agent are sufficiently attached to each other initially. Thereafter, the coloring agent is effectively dispersed in the toner particles in the toner manufacturing process and the dispersion particle diameter of the coloring agent decreases so that suitable transparency is obtained.

The binder resins specified above used as the binder resins for toner are used as the binder resins for use in preliminary kneading and mixing but the binder resins for use in preliminary kneading and mixing are not limited thereto.

A specific method of mixing and kneading a mixture of the binder resin and a coloring agent preliminarily together with a moistening liquid is to: mix a binder resin, a coloring agent, moistening liquid with a blender such as HENSCEL MIXER; and mix and knead the obtained mixture with a kneader such as a two-roll or a three-roll at a temperature lower than the melting point of the binder resin to obtain a sample.

In addition, typical known liquid can be used as the moistening liquid considering the solubility of the binder resin and the wettability of the coloring agent. Organic solvents such as acetone, toluene, and butanone, and water are preferred in terms of the dispersion property of the coloring agent. Among these, the usage of water is particularly preferred in consideration of environment, and maintenance of dispersion stability of the coloring agent in the toner manufacturing process thereafter.

According to this method, the particle diameter of the coloring agent particles contained in the obtained toner decreases and in addition the uniformity of the dispersion status of the particles increases. Therefore, the color representability for a projected image on a transparent sheet is further improved.

In the toner, the releasing agent is preferably contained in addition to the binder resin and the coloring agent.

There is no specific limit to the selection of such a releasing agent and any known releasing agent can be suitably used.

Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are particularly preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these waxes, polyalkane acid esters are particularly preferable.

The releasing agent preferably has a melting point of from 40 to 160° C., more preferably from 50 to 120° C., and furthermore preferably from 60 to 90° C. When the melting point of the releasing agent is too low, the high temperature preservability of the toner tends to deteriorate. In contrast, when the melting point is too high, a cold offset problem, i.e., an offset phenomenon that occurs at a low fixing temperature, tends to occur.

The releasing agent preferably has a melt viscosity of from 5 to 1000 cps and more preferably from 10 to 100 cps at a temperature 20° C. higher than the melting point of the releasing agent. When the melt viscosity is too high, the effect of improving the hot offset resistance and low temperature fixability is reduced.

The content of the releasing agent in the toner is preferably from 0 to 40% by weight and more preferably from 3 to 30%.

Also, the toner can optionally contain a charge control agent to improve the charging property and quicken the rise thereof. A charge control agent formed of colored material changes color of the toner. Therefore, the charge control agent is preferably made of transparent material or material having a white color or close thereto.

There is no specific limit to the selection of the charge control agent.

Specific examples of the charge control agent include, but are not limited to, known charge control agents such as triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives.

Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, and a quaternary ammonium group.

The content of the charge control agent is determined depending on the species of the binder resin used, whether or not an additive is added and the toner manufacturing method (including the dispersion method) used, and thus is not unambiguously defined. However, the content of the charge control agent is preferably from 0.1 to 10 parts by weight, and preferably from 0.2 to 5 parts by weight, based on 100 parts by weight of the binder resin included in the toner. When the content is too high, the toner tends to have an excessively large amount of charge, which reduces the effect of the charge control agent. Therefore, the electrostatic attraction force between a developing roller and the toner increases, resulting in deterioration of the fluidity of the toner and a decrease in the image density.

The charge control agent can be dissolved or dispersed in an organic solvent after the charge control agent is kneaded together with a master batch pigment and resin. In addition, the charge control agent can be directly dissolved or dispersed in an organic solvent when the toner component is dissolved or dispersed in an organic solvent. Alternatively, the charge control agent may be fixed on the surface of the toner particles after the toner particles are prepared.

In addition, resin particulates can be optionally added to stabilize dispersion when the toner component is dispersed in an aqueous medium in the toner manufacturing process.

Suitable resins used as the resin particles include any known resins that can form an aqueous dispersion body.

Specific examples of these resins include, but are not limited to, thermoplastic resins or thermosetting (thermocuring) resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins, and mixtures thereof are preferably used because an aqueous dispersion body including fine spherical particulates can be easily prepared.

Specific examples of the vinyl resins include, but are not limited to, polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

Inorganic particulates are suitable as an external additive to assist the fluidity, the developability and the charging property of toner particles.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Such inorganic particulates preferably have a primary particle diameter of from 5 nm to 2 μm, and more preferably from 5 nm to 500 nm. In addition, the specific surface area of such inorganic particulates measured by a BET method is preferably from 20 to 500 $m^2/g$. The content of the external additive is preferably from 0.01 to 5% by weight, and more preferably from 0.01 to 2.0% by weight, based on total weight of the toner.

In addition, other polymer particulates such as polymers and copolymers of styrene, methacrylates, acrylates or the like prepared by a soap-free emulsion polymerization method, a suspension polymerization method or a dispersion polymerization method and polymer particles of polycondensatoin or thermocuring resins such as silicone resins, benzoguanamine resins and nylon resins can also be used as the external additive.

Also, fluidizers can be optionally added to the toner.

These fluidizers can be hydrophobized by surface treatment to prevent deterioration of the fluidity and charge properties of the toner under high humidity conditions. Specific examples of the fluidizers include, but are not limited to, silane coupling agents, silylation agents, silane coupling agents including a fluoroalkyl group, organic titanate coupling agents, aluminum coupling agents, silicone oils, and modified silicone oils.

The toner for use in the present invention may include a cleaning improver to remove the toner (development agent) remaining on an image bearing member such as a photoreceptor and an intermediate transfer body. Specific examples of the cleaning improvers include, but are not limited to, zinc stearate, calcium stearate and metal soaps of stearic acid; polymer particulates such as polymethyl methacrylate particulates and polystyrene particulates, which are prepared by a soap-free emulsion polymerization method or the like, etc. The polymer particulates preferably have a narrow particle diameter distribution and the weight average particle diameter thereof is preferably from 0.01 to 1 μm.

Quality toner images can be formed with the stable developability as described above by using such toner.

In addition, the image forming apparatus of the present invention can be used for not only the polymerization toner having a suitable structure to obtain quality images but also pulverization toner having irregular forms. Also, the working life of the image forming apparatus is significantly elongated even when such pulverization toner is used. There is no specific limit to selection of material forming such pulverization toner as long as it can be used in electrophotography.

Specific examples of the binder resins for use in the pulverization toner include, but are not limited to, styrene polymers and substituted styrene homopolymers such as poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; homopolymers of acrylic esters or copolymers thereof such as polymethyl acrylate, polybutyl acrylate, polymethyl methacrylate, and polybutyl methacrylate; polyvinyl derivatives such as polyvinyl chloride and polyvinyl acetate; polyester-based polymers, polyurethane based polymers, polyamide based polymers, polyimide based polymers, polyol based polymers, epoxy based polymers, terpene based polymers, aliphatic or alicyclic hydro carbon resins and aromatic oil resins. These can be used alone or in combination. Among these, styrene-acrylic based copolymers, polyester based resins, and polyol based resins are preferable in terms of electric characteristics and cost and polyester based resins and polyol based resins are more preferable in terms of the fixing characteristics.

The pulverization toner is manufactured by: preliminarily mixing these resin components with the coloring agent component, the wax component, the charge control components, if desired; mixing and kneading them at a temperature around the melting point of the resin component; and cooling down the mixture followed by pulverization and classification process. The external additive specified above can be optionally admixed with the toner.

The development device is either of dry development type or wet development type and of a single color development type or a multi-color development type. The development device suitably includes, for example, a stirrer that triboelectrically charges the toner or the development agent, and a rotatable magnet roller.

In the development device, the toner and a carrier are mixed and stirred to triboelectrically charge the toner. The toner is then held on the surface of the rotating magnet roller in a filament manner to form a magnet brush. Since the magnet roller is provided in the vicinity of the image bearing member, part of the toner forming the magnet brush borne on the surface of the magnet roller is transferred to the surface of the image bearing member by electric attraction force. As a result, the latent electrostatic image is developed with the toner and visualized on the image on the surface of the image bearing member.

The development agent accommodated in the development device is a single component development agent (i.e., toner) or a two component development agent (i.e., toner and carrier).

Transfer Process and Transfer Device

The transfer process mentioned above is a process in which the visualized image mentioned above is transferred to a recording medium. It is preferred that the visualized image is primarily transferred to an intermediate transfer body and thereafter secondarily transferred to the recording medium. Further, it is more preferred use a two-color toner, preferably a full color toner in the processes in which the visualized image is primarily transferred to an intermediate transfer body to form a complex transfer image and the complex transfer image is thereafter secondarily transferred to the recording medium.

The transfer process can be performed by, for example, charging the latent electrostatic image bearing member (photoreceptor) with a transfer charging device and by the transfer device. The transfer device preferably has a primary transfer device to form a complex transfer image by transferring a visualized image to an intermediate transfer body and a secondary transfer device to transfer the complex transfer image to a recording medium.

There is no specific limit to the intermediate transfer body and any known transfer body can be suitably selected. For example, a transfer belt is preferably used.

An intermediate transfer system using an intermediate transfer body to which the toner image formed on the image bearing member is primarily transferred to overlap color images and from which the overlapped color image is transferred to to the recording medium can be suitably used.

Intermediate Transfer Body

The intermediate transfer body is preferably electroconductive with a voltage resistance of from $1.0\times10^{5}$ to $1.0\times10^{11}$ Ω·cm. A volume resistance that is too low may cause discharging, which leads to disturbance of formation of a toner image when the toner image is transferred from the image bearing member to the intermediate transfer body. When the volume resistance is too large, the charges to the toner image tend to remain on the intermediate transfer body which may appear on the next images as an accidental image after the toner image is transferred from the intermediate transfer body to a recording medium such as paper.

Plastic etc., having a belt form or a cylinder form that is manufactured by, for example, mixing and kneading metal oxide such as tin oxide or indium oxide, or electroconductive particles or electroconductive polymers alone or in combination with a thermoplastic resins followed by extraction can be used as the intermediate transfer body. An intermediate transfer body having an endless form can be manufactured by optionally adding the electroconductive particles or electroconductive polymers to a liquid resin containing cross-linking reactive monomers or oligomers and centrifugal molding while heating.

A component excluding the charge transport material from the material for the surface layer for use in the surface layer of the image bearing member is used and the resistance thereof is adjusted using an electroconductive material in combination on a suitable basis when the surface layer is provided to the intermediate transfer body.

The transfer device (the primary transfer body, the secondary transfer body) preferably has a transfer unit which peeling-charges the visualized image formed on the image bearing member (photoreceptor) to the side of the recording medium. One or more transfer units may be used. Specific examples of the transfer units include, but are not limited to, a corona transfer unit using corona discharging, a transfer belt, a transfer roller, a pressure transfer roller, and an adhesive transfer unit.

There is no specific limit to the recording medium and any known recording medium (recording paper) can be suitably used.

Protection Layer Formation Process and Protective Agent Application Device

The process of forming a protection layer is a process in which the protective agent of the present invention is added to the surface of the image bearing member after transfer.

The protection layer application device is used as the protective agent application device.

Fixing Process and Fixing Device

The fixing process is a process in which a visualized image transferred to a recording medium is fixed by the fixing device and can be performed every time color toner is transferred to the recording medium or at one time after color toner is accumulated.

There is no specific limit to the fixing device and any known fixing device can be suitably selected. Known pressure and heating devices are preferable and formed of a combination of a heating roller and a pressure roller or a combination of a heating roller, a pressure roller and an endless belt.

The fixing temperature by the pressure and heating roller is preferably from 80 to 200° C.

In the fixing process for use in the present invention, for example, any known optical fixing device can be used together with or in place of the fixing device described above.

The discharging process is a process in which a discharging bias is applied to the image bearing member to discharge the image bearing member and is suitably performed by a discharging device.

There is no specific limit to the discharging device and any known discharging device. For example, a discharging lamp, can be suitably selected as long as it can apply a discharging bias to the image bearing member.

The cleaning process is a process in which the toner remaining on the image bearing member is removed and can be performed by the cleaning device.

The cleaning device is preferably provided on the downstream side of the transfer device and the upstream side of the protective agent application device relative to the rotation direction of the image bearing member.

There is no specific limit to the cleaning device and any known cleaner can be selected as long as it can remove the toner remaining on the image bearing member. Preferred specific examples of such cleaners include, but are not limited to, a magnetic brush cleaner, an electroconductive roller cleaner, a blade cleaner, a brush cleaner, and a web cleaner.

The recycle process is a process in which the toner removed in the cleaning process is returned to the development device and suitably performed by a recycling device.

There is no specific limit to the recycling device and any known transfer device can be used.

The control process is a process in which each process is controlled and suitably performed by a control device.

There is no specific limit to the control device and any known control device is suitably selected as long as it controls each device. Devices such as a sequencer or a computer can be used the control device.

Figure 4:
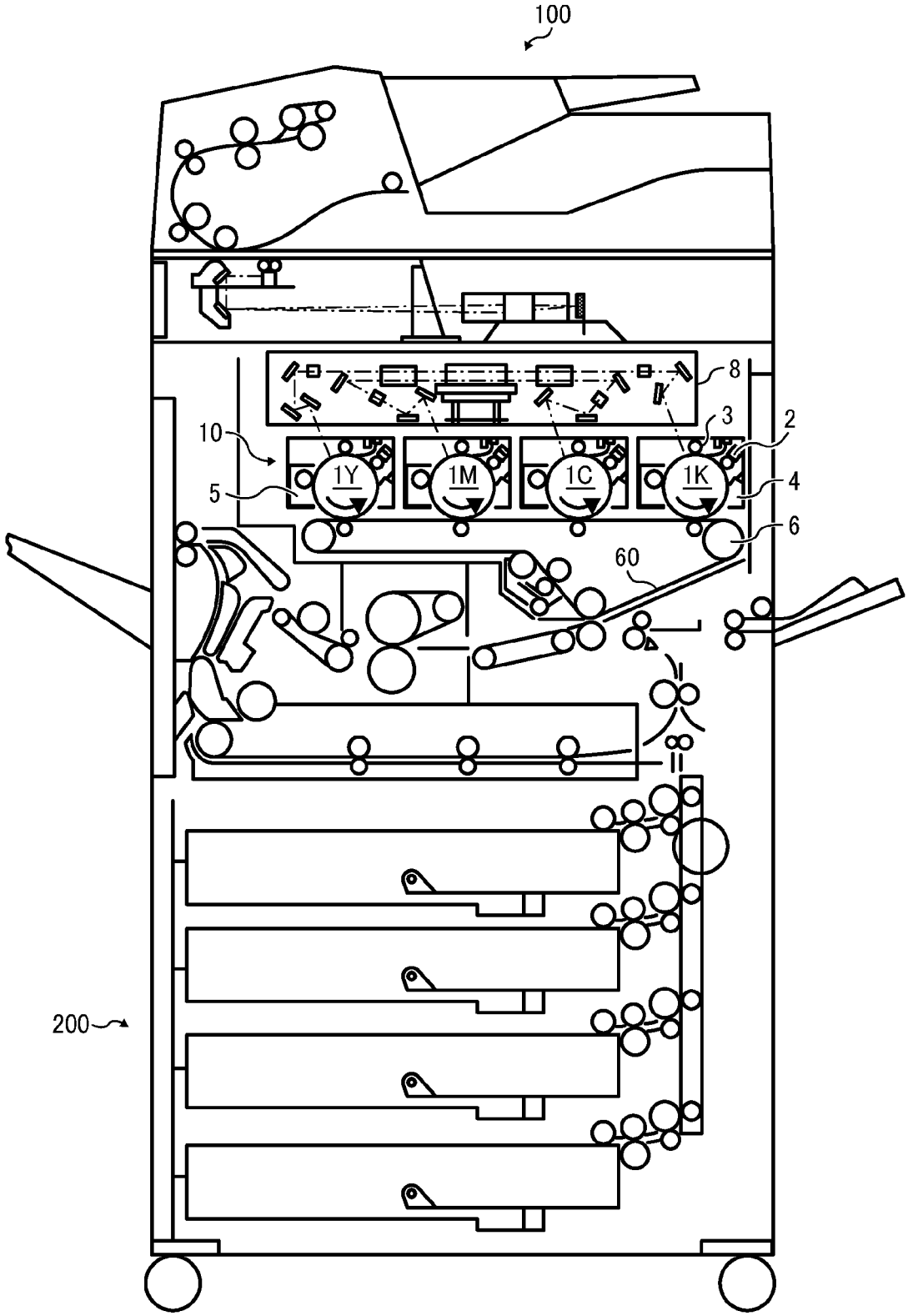
FIG. 4 is a cross section illustrating an example of the image forming apparatus including the protection layer formation device for use in the present invention.

FIG. 4 is a diagram illustrating a cross section of an example of the image forming apparatus 100 of the present invention.

A protection layer application device 2, a charging device 3, a latent image formation device 8, a development device 5, a transfer device 6 and a cleaning device 4 are provided around each of the image bearing member (photoreceptor) 1Y, 1M, 1C and 1K having a drum form and images are formed by the following operation.

A series of the image formation processes are described using a negative-positive process.

The image bearing member 100 typically represented by an organic photoconductor (OPC) having an organic photoconductive layer is discharged by a discharging lamp (not shown) and uniformly charged with a negative polarity by the charging device 3 having a charging member.

When the image bearing member 1 (representing 1Y, 1M, 1C and 1K) is charged, a voltage application mechanism (not shown) applies a charging bias having a suitable DC voltage or a voltage in which an AC voltage is overlapped with the suitable DC voltage to the charging member such that the image bearing member 1 is charged to a desired voltage.

A latent image is formed on the charged image bearing member 1 by a laser beam emitted from the latent image formation device 8 including, for example, a laser beam system. The absolute voltage at an irradiated portion is lower than the absolute voltage at a non-irradiated portion.

The laser beam is emitted from a semiconductor laser and reaches the surface of the image bearing member 1 through a polygon mirror having a polygonal column that is rotating at a high speed to scan the surface in the rotation axis direction of the image bearing member.

The thus formed latent image is developed by toner particles or a mixture of toner particles and carrier particles supplied onto the development sleeve functioning as a development agent bearing member included in the development device 5 to form a visualized toner image.

When the latent image is developed, a voltage application mechanism (not shown) applies a suitable development DC voltage or a bias in which an AC voltage is overlapped with the suitable development DC voltage to a development sleeve.

The toner images formed on the image bearing member 1 corresponding to each color is transferred to an intermediate transfer body 60 by the transfer device 6 and furthermore transferred to a recording medium such as paper fed from a paper feeding mechanism 200.

A voltage having a polarity reversed to that of the toner charging is preferably applied to the transfer device 6 as a transfer bias. Thereafter, the intermediate transfer body 60 is separated from the image bearing member 1 to obtain a transfer image.

In addition, the toner particles remaining on the image bearing member 1 is retrieved into a toner collection room by the cleaning member of the cleaning device 4.

A plurality of the development devices described above are contained in the image forming apparatus 100 and multiple toner images having a different color sequentially formed by the multiple development devices are sequentially transferred to transfer material (recording medium). Then, the multiple toner images are conveyed to the fixing mechanism which fixes toner with heat, etc. Alternatively, the multiple toner images are sequentially transferred to an intermediate transfer belt and then transferred to transfer material such as paper at one time followed by fixing as described above.

In addition, the charging device 3 is preferably provided in contact with or in the vicinity of the surface of the image bearing member 1 and a discharging wire is used in the charging device 3. Therefore, the amount of ozone, which is produced during charging, is significantly reduced in comparison with a corona discharger such as corotron or scorotron.

With regard to the charging device which performs charging by a charging member provided in contact with or in the vicinity of the surface of the image bearing member, discharging occurs in the area close to the surface of the image bearing member as described above. Therefore, the electric stress on the image bearing member tends to increase. However, when a protection layer application device using the protective agent block of the present invention is used, the image bearing member performs image formation without deterioration over a long period of time. Thus, variance in the quality of images over time or variance caused by the environment over time can be significantly reduced, which leads to stable securing of the quality of images.

The image forming apparatus of the present invention has a large tolerable range for the variance of the surface status of the image bearing member as described above and has a structure which reduces the variance in the charge control performance of the image bearing member. Therefore, a combination of the image forming apparatus and the toner having the composition described above stably forms extremely high quality images over a long period of time.

Process Cartridge

The process cartridge of the present invention includes an image bearing member, and a protective agent application device having the protective agent block of the present invention, and other optional devices such as a charging device, an irradiation device, a development device, a cleaning device and a discharging device.

The process cartridge of the present invention is detachably attachable to various kinds of electrophotographic apparatuses and preferably detachably attached to the image forming apparatus of the present invention.

Figure 3:
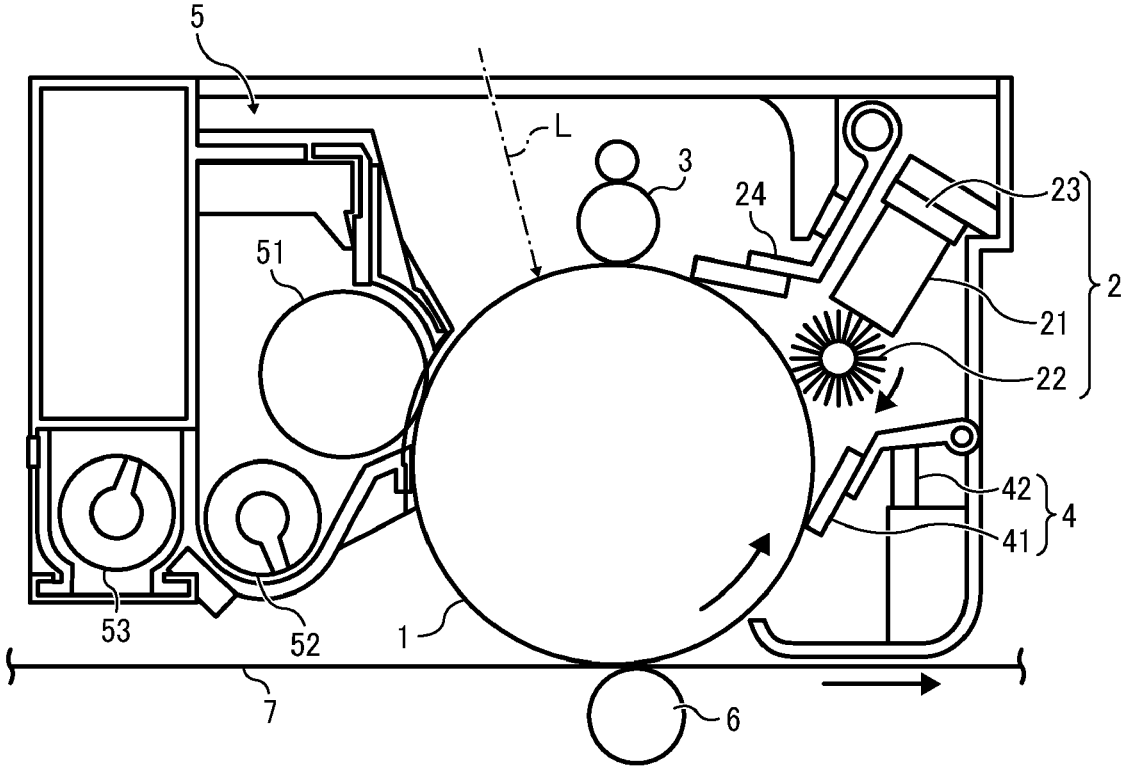
FIG. 3 is a schematic diagram illustrating a structure example of the process cartridge using the protection layer formation device for use in the present invention.

FIG. 3 is a schematic diagram illustrating a structure example of the process cartridge using a protection layer application device for use in the present invention.

The process cartridge includes the image bearing member 1 (photoreceptor drum 1) and the protection layer application device 2 provided facing the image bearing member 1. The protection layer application device 2 includes a protective agent block 21, a protective agent supply member 22, a pressure imparting member 23, a protection layer formation member 24, etc. The reference numeral 10 represents an image formation portion, the reference numeral 51 represents a development roller, and the reference numerals 52 and 53 represent stirring convey screws.

In addition, the image bearing member 1 has a surface on which partially degraded protective agent and toner components remain after transfer but the surface is cleaned by the cleaning device 4 having a cleaning member 41 and a cleaning pressure mechanism 42.

In FIG. 3, the cleaning member 41 is brought in contact with the image bearing member 1 with an angle in a counter manner or a trailing manner.

The protective agent 21 is supplied from the protective agent supply member 22 to the surface of the image bearing member 1 from which the residual toner and the partially degraded protective agent are removed by the cleaning mechanism. At this point, the protective agent for use in the present invention is stably and controllably supplied to the surface of the image bearing member 1 in a suitable amount. Therefore, the protective agent 21 efficiently protects the surface of the image bearing member 1 and prevents advance of deterioration of the image bearing member 1.

In FIG. 3, a protection layer formation member 24 is provided in a trailing direction but can be provided in a counter direction as in FIG. 2. In particular, when the linear velocity of the image bearing member 1 reaches 180 mm/s or faster, the protection layer formation member 24 contacting in the counter direction is preferred because the formation of the protection layer is faster.

A latent electrostatic image is formed on the image bearing member 1 having the thus prepared protection layer by irradiation beam L such as a laser beam after charging, developed by the development device 5 to obtain a visualized image, and transferred to a recording medium 7 by the transfer roller 6 situated outside the process cartridge.

As described above, the process cartridge of the present invention has a large tolerable range for the variance of the surface status of the image bearing member 1 and has a structure which reduces the variance in the charge control performance of the image bearing member. Therefore, a combination of the process cartridge and the toner having the composition described above stably forms extremely high quality images over a long period of time.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Method of Protective Agent Blocks 1 to 4

Protective agents 1 to 4 are manufactured as follows: weighing zinc stearate and zinc palmitate in the ration shown in Table 1 and heating and melting the mixture at 145° C.; and pouring the melted zinc stearate into a molding followed by cooling down. The protective agents 1 to 4 obtained have a dimension of 40 mm×8 mm with a length of 350 mm. Since the protective agents are manufactured by melting molding, the compression degree is 100%.

TABLE 1

| | Zinc stearate | Zinc palmitate |
|---|---|---|
| Protective agent block 1 | 55% by weight | 45% by weight |
| Protective agent block 2 | 64% by weight | 36% by weight |
| Protective agent block 3 | 68% by weight | 32% by weight |
| Protective agent block 4 | 100% by weight | 0% by weight |

Manufacturing Method of Protective Agent Blocks 5 to 10

Protective agents 5 to 10 are manufactured as follows:

First, particles (particle diameter from 22 to 35 μm) in which zinc stearate and zinc palmitate are compatible are manufactured by mixing stearic acid and palmitic acid in a particular ratio and mixing and melting the mixture with zinc hydroxide.

Then, each manufactured particle is dissolved in a solution of hydrochloric acid and methanol and heated to 80° C. to methylate the stearic acid and the palmitic acid. The contents of the stearic acid and palmitic acid are measured by gas chromatography and converted in the weight ratio of zinc stearate and zinc palmitate.

The particles in which zinc stearate and zinc palmitate are compatible are press-molded to 93% against the true specific gravity (all of zinc stearate, zinc palmitate, mixture of zinc stearate and zinc palmitate have a true specific gravity of 1.1) to obtain protective agents 5 to 10 having a dimension of 40 mm×8 mm with a length of 350 mm.

TABLE 2

| | Zinc stearate | Zinc palmitate |
|---|---|---|
| Protective agent block 5 | 66% by weight | 34% by weight |
| Protective agent block 6 | 60% by weight | 40% by weight |
| Protective agent block 7 | 56% by weight | 44% by weight |
| Protective agent block 8 | 47% by weight | 53% by weight |
| Protective agent block 9 | 41% by weight | 59% by weight |
| Protective agent block 10 | 37% by weight | 63% by weight |

Manufacturing Method of Protective Agent Blocks 11 and 12

The mixture of zinc stearate and zinc palmitate for use in the protective agent block 7 is mixed with boron nitride having a primary particle diameter of about 0.4 μm such that the content of the boron nitride is 6% by weight and 15% by weight for the protective agent agents 11 and 12, respectively. The mixtures are press-molded to 96% against the true specific gravity to obtain the protective agents 11 and 12 having a dimension of 40 mm×8 mm with a length of 350 mm.

Method of Manufacturing Image Bearing Member

Image Bearing Member 1

Liquid applications of an undercoating layer, a charge generation layer, a charge transport layer and a protection layer are sequentially applied to an aluminum drum (electroconductive substrate) having a diameter of 40 mm, and then dried to manufacture an image bearing member having an undercoating layer having a thickness of 4.2 μm, a charge generation layer having a thickness of about 0.15 μm, a charge transport layer having a thickness of 21 μm, and a protection layer having a thickness of about 4.5 μm. The protection layer is applied by a spraying method and the other layers are applied by a dip coating method. Alumina having an average particle diameter of 0.2 μm is added to the protection layer in an amount of 21.5% by weight.

Liquid Application for Undercoating Layer

| | |
|---|---|
| Alkyd resin (Beckozole 1307-60-EL, manufactured by Dainippon Ink and Chemicals, Inc.) | 6 parts |
| Melamine resin (Super-beckamine G-821-60, manufactured by Dainippon Ink and Chemicals, Inc.) | 4 parts |
| Titanium oxide | 40 parts |
| Methylethylketone | 200 parts |

Liquid Application for Charge Generation Layer

| | |
|---|---|
| Y type oxotitanyl phthalocyanine pigment | 2 parts |
| Polyvinyl butyral (S-LEC BM-S, manufactured by Sekisui Chemical Co., Ltd.) | 0.2 parts |
| Tetrahydrofuran | 50 parts |

Liquid Application for Charge Transport Layer

| | |
|---|---|
| Bisphenol A type polycarbonate resin (PANLITE K1300, manufactured by Teijin Chemicals Ltd.) | 10 parts |
| Low molecular weight charge transport material having the following structure | |

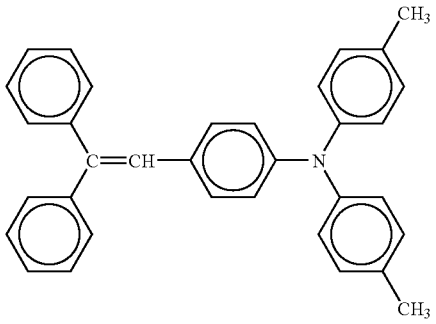

| | |
|---|---|
| Methylene chloride | 100 parts |

Liquid Application for Protection Layer

| | |
|---|---|
| Polycarbonate | 10.1 parts |
| Low molecular weight charge transport material illustrated above | 7 parts |
| Alumina particulate (center particle diameter: 0.20 μm) | 3.7 parts |
| Dispersoin helping agent (BYK-P104, manufactured by BYK Chemie Japan) | 0.08 parts |
| Tetrahydrofuran | 700 parts |
| Cyclohexanone | 200 parts |

Image Bearing Member 2

The image bearing member 2 is manufactured in the same manner as in the image bearing member 1 except that the liquid application of protection layer is changed to the following:

Liquid Application for Protection Layer

| | |
|---|---|
| Polycarbonate | 10.1 parts |
| Low molecular weight charge transport material illustrated above | 7.1 parts |
| Alumina particulate (center particle diameter: 0.25 μm) | 3.9 parts |
| Dispersoin helping agent (BYK-P104, manufactured by BYK Chemie Japan) | 0.1 parts |
| Tetrahydrofuran | 750 parts |
| Cyclohexanone | 220 parts |

Examples 1 and 2 and Comparative Examples 1 and 2

A tandem type color image forming apparatus (imagio MP C3500, manufactured by Ricoh Co., Ltd.) is remodeled such that the protective agent blade is provided in a counter manner to have the same structure as illustrated in FIG. 3, the linear velocity of the image bearing member is set at 280 mm/s and the pressure (linear pressure) from the protection layer formation member to the image bearing member is 18 gf/cm$^2$ and the same linear pressure is set for other Examples and Comparative Examples and in addition, a DC voltage of −600 V, and an AC of an amplitude of 1.2 KV, and a frequency of 2 KHz are applied to the image bearing member by the charging roller.

Four process cartridges are respectively manufactured using a combination of the image bearing member 1 and one of the protective agent blocks 1 to 4 and installed into the remodeled tandem type image forming apparatus. A test chart having an image density of 7% is formed on a 5 sheets by 5 sheets basis in an environment of 23° C. and 45% of humidity and the test chart is printed on 25,000 sheets in total.

Thereafter, half tone images of yellow, cyan, magenta, and black are output and evaluated.

The images formed by the image forming apparatus having the protective agent block 1 or 2 are quality half tone images.

Cyan, magenta and black images formed by the image forming apparatus using the protective agent block 3 have fine streaks. The magenta and the black images are apparently abnormal images.

Yellow, cyan, magenta and black images formed by the image forming apparatus using the protective agent block 4 have fine streaks. The cyan, the magenta and the black images are apparently abnormal images.

Examples 3 to 7 and Comparative Example 3

The image forming apparatus of Example 1 is remodeled such that the linear velocity is set at 220 mm/s and a DC voltage of −600 V, and an AC of an amplitude of 1.2 KV, and a frequency of 1.7 KHz are applied to the image bearing member by the charging roller.

Four process cartridges are respectively manufactured using a combination of the image bearing member 2 and one of the protective Example 8

The image forming apparatus of Example 5 is remodeled such that the linear velocity is set at 180 mm/s and a DC voltage of −600 V, and an AC of an amplitude of 1.2 KV, and a frequency of 1.3 KHz are applied to the image bearing member by the charging roller.

Images are printed as in Example 5 and the half tone images of each color formed after 30,000 images are of high quality.

Examples 9, 10 and Comparative Example 4

Four process cartridges are respectively manufactured using a combination of the image bearing member 1 and one of the protective agent blocks 11, 12 and 3 and installed into the remodeled tandem type image forming apparatus. A test chart having an image density of 7% is printed on a 5 sheets by 5 sheets basis in an environment of 17° C. and 10% of humidity and the test chart is printed on 15,000 sheets in total.

Thereafter, half tone images of yellow, cyan, magenta, and black are output and evaluated.

The images formed by the image forming apparatus having the protective agent block 11 or 12 are quality half tone images.

With regard to the images formed by the image forming apparatus having the protective agent block 3, fine streaks appear on the half tone images of every color. Particularly, the cyan, the quality of the magenta and the black images is out of the tolerable range.

Image Bearing Member 3

Liquid applications of an undercoating layer, a charge generation layer, a charge transport layer and a protection layer are sequentially applied to an aluminum drum (electroconductive substrate) having a diameter of 40 mm, and then dried to manufacture an image bearing member having an undercoating layer having a thickness of 4.2 μm, a charge generation layer having a thickness of about 0.15 μm, a charge transport layer having a thickness of 22 μm, and a protection layer having a thickness of about 4.0 μm. The protection layer is applied by a spraying method and the other layers are applied by a dip coating method.

Liquid Application for Undercoating Layer

| | |
|---|---|
| Alkyd resin (Beckozole 1307-60-EL, manufactured by Dainippon Ink and Chemicals, Inc.) | 6 parts |
| Melamine resin (Super-beckamine G-821-60, manufactured by Dainippon Ink and Chemicals, Inc.) | 4 parts |
| Titanium oxide | 40 parts |
| Methylethylketone | 200 parts |

Liquid Application for Charge Generation Layer

| | |
|---|---|
| Y type oxotitanyl phthalocyanine pigment | 2 parts |
| Polyvinyl butyral (S-LEC BM-S, manufactured by Sekisui Chemical Co., Ltd.) | 0.2 parts |
| Tetrahydrofuran | 50 parts |

Liquid Application for Charge Transport Layer

| | |
|---|---|
| Bisphenol A type polycarbonate resin (PANLITE K1300, manufactured by Teijin Chemicals Ltd.) | 10 parts |
| Low molecular weight charge transport material having the following structure | |

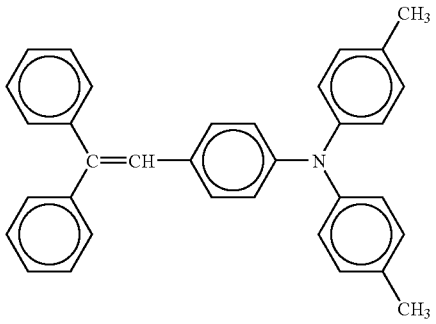

| | |
|---|---|
| Methylene chloride | 100 parts |

Liquid Application for Protection Layer

| | |
|---|---|
| Polycarbonate | 10 parts |
| Low molecular weight charge transport material illustrated above | 7 parts |
| Alumina particulate (center particle diameter: 0.30 μm) | 6 parts |
| Dispersoin helping agent (BYK-P104, manufactured by BYK Chemie Japan) | 0.08 parts |
| Tetrahydrofuran | 700 parts |
| Cyclohexanone | 200 parts |

Image Bearing Member 4

The image bearing member 4 is manufactured in the same manner as in the image bearing member 3 except that the aluminum particulates agent blocks 5 to 10 and installed into the remodeled tandem type image forming apparatus. A test chart having an image density of 7% is printed on a 5 sheets by 5 sheets basis in an environment of 27° C. and 45% of humidity and the test chart is printed on 30,000 images in total.

Thereafter, half tone images of yellow, cyan, magenta, and black are output and evaluated.

With regard to the images formed by the image forming apparatus having the protective agent block 5, streaks are slightly found in black images but are practically allowable.

The images formed by the image forming apparatus having one of the protective agent blocks 6 to 8 are quality half tone images for every color.

With regard to the images formed by the image forming apparatus having the protective agent block 9, dot flows are locally found with a magnifying glass for the cyan and the black images but practically all the color images are within the tolerable range.

With regard to the images formed by the image forming apparatus using the protective agent block 10 of Comparative Example, dot flows are locally found in colors except for yellow with a magnifying glass. Particularly, the magenta and the black images are out of the tolerable range.

10,000 images are furthermore printed by the image forming apparatus using one of the protective agent blocks 6 to 8 and quality images are obtained in each case.

(center particle diameter: 0.30 μm) in an amount of 6 parts by weight in the liquid application for protection layer is changed to aluminum particulates (center particle diameter: 0.32 μm) in an amount of 6.2 parts by weight.

Analysis and Analysis Method on Image Bearing Member

Two image bearing members 3 before the protective agent is applied are selected at random and subject to XPS (AXIS/ULTRA, Shimadzu Corporation/KRATOS, X ray source: Mono Al, Analysis area: 700×300 μm) analysis. FIG. 6 is a diagram illustrating the obtained spectrum.

With regard to C1s spectrum illustrated in FIG. 6, the entire area $Y_0$ of C1s spectrum in the range of from 281 to 296 eV is calculated as one piece and the area $W_0$ (waveform G: diagonal lined portion) of the peaks detected in the range of from 290.3 to 294 eV is calculated as one piece. $A_0$ is obtained from the relationship: $A_0=W_0/Y_0\times100$. $A_0$ is 8.7% for each image bearing member.

The XPS analysis is conducted on two randomly selected image bearing members 4 before the protective agent is applied in the same manner as in the case of the image bearing member 3. $A_0$ is 8.7% for each image bearing member.

The values of $A_0$ are constant in principle irrespective of the amount of aluminum in the protection layer of the image bearing members 1 or 2, which is supported by the results described above.

According to the analysis results on the four image bearing members, the cover ratio is calculated based on $A_0$ (=8.7%). FIGS. 7 and 8 are used to describe how to calculate A. As described above, the spectra illustrated in FIGS. 7 and 8 are the same. The spectrum illustrated in FIG. 7 is as is and the waveform G' (diagonal lined portions in FIG. 8) is added in the spectrum illustrated in FIG. 8 for convenience.

With regard to C1s spectrum as illustrated in FIG. 7, the entire area Y of C1s spectrum in the range of from 281 to 296 eV is calculated as one piece. The waveform G in the range of from 290.3 to 294 eV (peak top) in FIG. 6 is similarly contracted to the spectrum in the range of 290.3 to 294 eV (peak top) in FIG. 7 as the waveform G' in FIG. 8 to obtain the area W thereof.

$A$ is calculated from the relationship: $A=W/Y\times100$.

Calculation Method of Cover Ratio

The cover ratio is calculated according to the following relationship:

$$\text{Cover ratio}=\{(A_0-A)/A_0\times100\}(\%) \qquad \text{Relationship (1)}$$

Examples 11 and 12 and Comparative Examples 5 and 6

A tandem type color image forming apparatus (imagio MP C3500) is remodeled such that the protective agent application blade is provided in the counter manner to have the structure illustrated in FIG. 2. The linear velocity of the image bearing member is set at 280 mm/s. In addition, charging is adjusted such that a DC of −600 and an AC having an amplitude of 1.2 kV and a frequency of 2 kHz is applied to the image bearing member to the charging roller.

Four process cartridges are manufactured for each combination of the image bearing member 3 and the protective agent blocks 1 to 4 and installed into the remodeled tandem type image forming apparatus. A test chart having an image density of 7% is printed on 500 sheets at 20° C. and 43% of humidity. The image bearing member assigned for yellow is extracted from each process cartridge and XPS (AXIS/ULTRA, Shimadzu Corporation/KRATOS, X ray source: Mono Al, Analysis area: 700×300 μm) analysis is conducted to calculate A. A's for the process cartridges using the protective agent blocks 1, 2, 3 or 4 are 0, 0.6, 1.0 and 1.4, respectively. The cover ratios thereof are calculated according to the relationship (1) and the results are 100, 93, 88 and 84%.

Next, a new image bearing member is installed into the yellow process cartridge and a test chart having an image density of 7% is printed on 2,500 sheets on a 5 sheets by 5 sheets basis in total.

Thereafter, half tone images of cyan, magenta and black are output and each image is evaluated.

As a result, the halftone images output by the image forming apparatus using the protective agent block 1 or 2 are of high quality for every color.

The halftone images output by the image forming apparatus using the protective agent block 3 are abnormal images having fine streaks for cyan, magenta and black and particularly magenta and black.

The halftone images output by the image forming apparatus using the protective agent block 4 are abnormal images having fine streaks for yellow, cyan, magenta and black and particularly cyan, magenta and black.

Examples 13 to 17 and Comparative Example 7

The image forming apparatus for use in Example 11 is remodeled such that the linear velocity of the image bearing member is set at 200 mm/s, and charging is adjusted such that a DC of −600 and an AC having an amplitude of 1.2 kV and a frequency of 1.7 kHz is applied to the image bearing member to the charging roller.

Four process cartridges are manufactured for each combination of the image bearing member 4 and the protective gent blocks 5 to 10 and installed into the remodeled tandem type image forming apparatus. A test chart having an image density of 7% is formed on 500 sheets at 25° C. and 42% of humidity. The image bearing member assigned for yellow is extracted from each process cartridge and XPS (AXIS/ULTRA, Shimadzu Corporation/KRATOS, X ray source: Mono Al, Analysis area: 700×300 μm) analysis is conducted to calculate A. A's for the process cartridges using the protective agent blocks 5, 6, 7, 8, 9 and 10 are 0.8, 0.4, 0, 0.2, 0.8 and 1.1, respectively. The cover ratios thereof are calculated according to the relationship (1) and the results are 91, 95, 100, 98, 91 and 87%. Furthermore, the element analysis is performed for the image bearing member for yellow with regard to the protective agent 10 and the content of Zn is 2.37%. The cover ratio is converted using the assumption that all the protective agent on the image bearing member is a mixture of zinc stearate (37%) and a zinc palmitate (63%) free from oxidization. If the block 10 free from oxidization covers all over the image bearing member, the ratio of Zn is 2.60% according to the relationship. Therefore, the calculated cover ratio is 91% using 2.60% as the saturation amount of the ratio of Zn. The calculation is as follows:

The relationship of ratio of Zn=(2.44×ratio of zinc stearate)+(2.70×ratio of zinc palmitate)=2.44×0.37+2.70×0.63=2.60 Cover ratio: (2.37/2.60)×100=91%.

Next, a new image bearing member is installed into the yellow process cartridge and a test chart having an image density of 7% is printed on 3,000 sheets on a 5 sheets by 5 sheets basis in total.

Thereafter, half tone images of cyan, magenta and black are output and each image is evaluated.

As a result, the images output by the image forming apparatus using the protective agent block 5 are of high quality for every color except for black having slight freaks, which is practically allowable.

The halftone images output by the image forming apparatus using the protective agent block 6, 7 or 8 are of high quality for every color.

The images output by the image forming apparatus using the protective agent block 9 have slight dot flow portions observed by a magnifying glass with regard to the cyan or black images but practically are of high quality for every color.

The images output by the image forming apparatus using the protective agent block 10 have dot flow portions observed by a magnifying glass with regard to the cyan, black, or magenta images, which are out of the tolerable range for magenta and black in particular.

The image is furthermore formed on 10,000 sheets by the image forming apparatus using the protective agent block 6, 7 or 8. The images on the sheets are of high quality in each case of the image forming apparatuses.

Example 18

The image forming apparatus for use in Example 18 is remodeled based on the image forming apparatus of Example 15 using the protective agent block 7 such that the linear velocity of the image bearing member is set at 160 mm/s, and charging is adjusted such that a DC of −600 and an AC having an amplitude of 1.2 kV and a frequency of 1.3 kHz is applied to the image bearing member by the charging roller.

The test chart having an image density of 7% is printed on 500 sheets at 25° C. and 42% of humidity as described in Example 15. The image bearing member assigned for yellow is extracted from each process cartridge and XPS (AXIS/ULTRA, Shimadzu Corporation/KRATOS, X ray source: Mono Al, Analysis area: 700×300 μm) analysis is conducted to calculate A, which is 1.1. The cover ratio is calculated according to the relationship (1) and the result is 100%.

Next, a new image bearing member is installed into the yellow process cartridge and a test chart having an image density of 7% is printed on 3,000 sheets on a 5 sheets by 5 sheets basis in total. Thereafter, halftone images of cyan, magenta and black are output and evaluated. Those images are of high quality for every color.

Examples 19 and 20 and Comparative Example 8

Four process cartridges are manufactured for each combination of the image bearing member 3 and the protective agent block 11, 12 or 3 and installed into the image forming apparatus of Example 13. The test chart having an image density of 7% is printed on 500 sheets at 15° C. and 10% of humidity. The image bearing member assigned for yellow is extracted from each process cartridge and XPS (AXIS/ULTRA, Shimadzu Corporation/KRATOS, X ray source: Mono Al, Analysis area: 700×300 μm) analysis is conducted to calculate A, which are 0, 0, 1.1. The cover ratios are calculated according to the relationship (1) and the results are 100, 100, and 87%.

Next, a new image bearing member is installed into the yellow process cartridge and a test chart having an image density of 7% is printed on 15,000 sheets on a 5 sheets by 5 sheets basis in total. Thereafter, halftone images of cyan, magenta and black are output and evaluated. Those images produced by the image forming apparatus using the protective agent block 11 or 12 are of high quality for every color.

The halftone images produced by the image forming apparatus using the protective agent block 3 have fine streaks for each color, which are outside the tolerable range.

TABLE 3

| Example/ Comparative Example | Protective agent block | Molding method | Zinc stearate (% by weight) | Zinc palmitate (% by weight) | Boron nitride (% by weight) | A | Cover ratio (%) | Evaluation result |
|---|---|---|---|---|---|---|---|---|
| Example 11 | Protective agent block 1 | Melting molding | 55 | 45 | — | 0 | 100 | G |
| Example 12 | Protective agent block 2 | Melting molding | 64 | 36 | — | 0.6 | 93 | G |
| Comparative Example 5 | Protective agent block 3 | Melting molding | 68 | 32 | — | 1 | 88 | B |
| Comparative Example 6 | Protective agent block 4 | Melting molding | 100 | 0 | — | 1.4 | 84 | B |
| Example 13 | Protective agent block 5 | Compacting molding | 66 | 34 | — | 0.8 | 91 | F |
| Example 14 | Protective agent block 6 | Compacting molding | 60 | 40 | — | 0.4 | 95 | G |
| Example 15 | Protective agent block 7 | Compacting molding | 56 | 44 | — | 0 | 100 | G |
| Example 16 | Protective agent block 8 | Compacting molding | 47 | 53 | — | 0.2 | 98 | G |
| Example 17 | Protective agent block 9 | Compacting molding | 41 | 59 | — | 0.8 | 91 | F |
| Comparative Example 7 | Protective agent block 10 | Compacting molding | 37 | 63 | — | 1.1 | 87 | B |
| Example 18 | Protective agent block 7 | Compacting molding | 56 | 44 | — | 0 | 100 | G |
| Example 19 | Protective agent block 11 | Compacting molding | 56 | 44 | 6* | 0 | 100 | G |
| Example 20 | Protective agent block 12 | Compacting molding | 56 | 44 | 15* | 0 | 100 | G |
| Comparative Example 8 | Protective agent block 3 | Melting molding | 68 | 32 | — | 1.1 | 87 | B |

*ratio of boron nitride is calculated to the mixture of zinc stearate and zinc palmitate.

The evaluation criteria shown in Table 3 are as follows:

G (Good): high quality

F (Fair): inferior in quality causing no practical problem)

B (Bad): Abnormal image

This document claims priority and contains subject matter related to Japanese Patent Applications Nos. 2008-135197 and 2008-140428, filed on May 23, 2009, and May 29, 2009, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear a latent electrostatic image on a surface thereof;

a charging device configured to uniformly charge the surface of the image bearing member;

an irradiation device configured to irradiate the surface of the image bearing member to form the latent electrostatic image thereon;

a development device configured to develop the latent electrostatic image on the surface of the image bearing member with toner to form a toner image thereon;

a transfer device configured to transfer the toner image to a transfer body;

a cleaning device comprising a cleaning blade which is configured to remove residual toner remaining on the surface of the image bearing member with the cleaning blade;

a protective agent application device configured to apply a protective agent comprising zinc stearate and zinc palmitate to the surface of the image bearing member, wherein a ratio of the zinc stearate and the zinc palmitate is from 66:34 to 40:60 by weight, and wherein with regard to C1s spectrum detected when the image bearing member is analyzed by X-ray photoelectron spectroscopy (XPS) before the protective agent is applied to the surface of the image bearing member and peaks obtained by separating waveforms generated from different bonding statuses of carbon atoms according to binding energy, the image bearing member has a ratio $A_0$ of a sum of peak areas having a top of the peaks in a range of from 290.3 to 294 eV to a total area of the C1s spectrum of at least 3%, and with regard to C1s spectrum detected when the image bearing member is analyzed by X-ray photoelectron spectroscopy (XPS) after 500 images are output while the protective agent is applied to the image bearing member and the peaks obtained by separating waveforms generated from different bonding statuses of carbon atoms according to binding energy, a ratio A of a sum of peak areas having a top of the peaks in a range of from 290.3 to 294 eV to the total area of the C1s spectrum satisfies the following relationship:

$$(A_0-A)/A_0\times100\geqq90(\%).$$

2. The image forming apparatus according to claim 1, wherein the protective agent is manufactured by compacting molding.

3. The image forming apparatus according to claim 1, wherein the protective agent comprises boron nitride.

4. The image forming apparatus according to claim 3, wherein a content of the boron nitride of from 1 to 25% by weight based on a total content of the protective agent.

5. The image forming apparatus according to claim 1, wherein the image bearing member has a linear velocity of 180 mm/s or higher.

6. The image forming apparatus according to claim 1, wherein the charging device uniformly charges the surface of the image bearing member by applying a voltage in which an AC voltage is overlapped with a DC voltage to the image bearing member.

7. The image forming apparatus according to claim 1, wherein the protective agent application device is provided on a downstream side from the cleaning device relative to a rotation direction of the image bearing member.

8. A process cartridge comprising:

an image bearing member configured to bear a latent electrostatic image on a surface thereof;

a protective agent application device configured to apply a protective agent comprising zinc stearate and zinc palmitate to the surface of the image bearing member;

at least one device selected from the group consisting of a charging device, an irradiation device, a development device, and a cleaning device, wherein the process cartridge is detachably attachable to the image forming apparatus of claim 1.

9. A protective agent block comprising:

zinc stearate; and zinc palmitate, wherein the protective agent block is attached to the process cartridge of claim 8.

10. A protective agent block comprising:

zinc stearate; and zinc palmitate, wherein the protective agent block is attached to the image forming apparatus of claim 1.

* * * * *